US007784902B2

(12) United States Patent
Silverbrook

(10) Patent No.: US 7,784,902 B2
(45) **Date of Patent: *Aug. 31, 2010**

(54) PRINTHEAD INTEGRATED CIRCUIT WITH MORE THAN 10000 NOZZLES

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 459 days.

This patent is subject to a terminal disclaimer.

(21) Appl. No.: 11/829,966

(22) Filed: Jul. 30, 2007

(65) Prior Publication Data

US 2007/0268332 A1 Nov. 22, 2007

Related U.S. Application Data

(63) Continuation-in-part of application No. 10/407,207, filed on Apr. 7, 2003, now Pat. No. 7,252,366, which is a continuation of application No. 09/113,122, filed on Jul. 10, 1998, now Pat. No. 6,557,977.

(30) Foreign Application Priority Data

Jul. 15, 1997 (AU) ..... PO7991
Jul. 15, 1997 (AU) ..... PO8004

(51) Int. Cl.
*B41J 2/145* (2006.01)
*B41J 2/15* (2006.01)

(52) U.S. Cl. ..... 347/40; 347/56

(58) Field of Classification Search ..... 347/12, 347/20, 40–43, 56–59
See application file for complete search history.

(56) References Cited

U.S. PATENT DOCUMENTS

| | | | |
|---|---|---|---|
| 4,423,401 | A | 12/1983 | Mueller |
| 4,553,393 | A | 11/1985 | Ruoff |
| 4,672,398 | A | 6/1987 | Kuwabara et al. |
| 4,737,802 | A | 4/1988 | Mielke |
| 4,864,824 | A | 9/1989 | Gabriel et al. |
| 5,029,805 | A | 7/1991 | Albarda et al. |
| 5,258,774 | A | 11/1993 | Rogers |

(Continued)

FOREIGN PATENT DOCUMENTS

DE 1648322 A 3/1971

(Continued)

OTHER PUBLICATIONS

Ataka, Manabu et al, "Fabrication and Operation of Polymide Bimorph Actuators for Ciliary Motion System". Journal of Microelectromechanical Systems, US, IEEE Inc. New York, vol. 2, No. 4, Dec. 1, 1993, pp. 146-150, XP000443412, ISSN: 1057-7157.

(Continued)

*Primary Examiner*—Thinh H Nguyen

(57) ABSTRACT

A printhead integrated circuit having a monolithic wafer substrate supporting an array of droplet ejectors for ejecting drops of printing fluid onto print media. Each drop ejector has a nozzle and an actuator for ejecting a drop of printing fluid through the nozzle. The array has more than 10000 of the droplet ejectors so that it provides a high nozzle pitch and the printhead has a very high 'true' print resolution—i.e. the high number of dots per inch is achieved by a high number of nozzles per inch.

17 Claims, 17 Drawing Sheets

U.S. PATENT DOCUMENTS

| | | | | |
|---|---|---|---|---|
| 5,640,183 | A | | 6/1997 | Hackleman |
| 5,666,141 | A | | 9/1997 | Matoba et al. |
| 5,719,602 | A | * | 2/1998 | Hackleman et al. ..... 347/14 |
| 5,719,604 | A | | 2/1998 | Inui et al. |
| 5,903,380 | A | | 5/1999 | Motamedi et al. |
| 5,982,521 | A | | 11/1999 | Bessho et al. |
| 2002/0149649 | A1 | | 10/2002 | Moon et al. |
| 2002/0175973 | A1 | | 11/2002 | Moon et al. |
| 2006/0181576 | A1 | | 8/2006 | Endo et al. |
| 2007/0091146 | A1 | | 4/2007 | Endo et al. |

FOREIGN PATENT DOCUMENTS

| | | | |
|---|---|---|---|
| DE | 2905063 | | 8/1980 |
| DE | 3245283 | A | 6/1984 |
| DE | 3430155 | A | 2/1986 |
| DE | 3716996 | A | 12/1988 |
| DE | 3934280 | A | 4/1990 |
| DE | 4328433 | A | 3/1995 |
| DE | 19516997 | A | 11/1995 |
| DE | 19517969 | A | 11/1995 |
| DE | 19532913 | A | 3/1996 |
| DE | 19623620 | A1 | 12/1996 |
| DE | 19639717 | A | 4/1997 |
| EP | 0092229 | A | 10/1983 |
| EP | 0398031 | A | 11/1990 |
| EP | 0427291 | A | 5/1991 |
| EP | 0431338 | A | 6/1991 |
| EP | 0478956 | A | 4/1992 |
| EP | 0506232 | A | 9/1992 |
| EP | 0510648 | A | 10/1992 |
| EP | 0627314 | A | 12/1994 |
| EP | 0634273 | A2 | 1/1995 |
| EP | 0713774 | A2 | 5/1996 |
| EP | 0737580 | A | 10/1996 |
| EP | 0750993 | A | 1/1997 |
| EP | 0882590 | A | 12/1998 |
| FR | 2231076 | A | 12/1974 |
| GB | 792145 | A | 3/1958 |
| GB | 1428239 | A | 3/1976 |
| GB | 2262152 | A | 6/1993 |
| JP | 58-112747 | A | 7/1983 |
| JP | 58-116165 | A | 7/1983 |
| JP | 59-093356 | A | 5/1984 |
| JP | 61-025849 | A | 2/1986 |
| JP | 61-268453 | A | 11/1986 |
| JP | 01-105746 | A | 4/1989 |
| JP | 01-115639 | A | 5/1989 |
| JP | 01-128839 | A | 5/1989 |
| JP | 01-257058 | A | 10/1989 |
| JP | 01-306254 | A | 12/1989 |
| JP | 03-202351 | A | 12/1989 |
| JP | 02-050841 | A | 2/1990 |
| JP | 02-092643 | A | 4/1990 |
| JP | 02-108544 | A | 4/1990 |
| JP | 02-158348 | A | 6/1990 |
| JP | 02-162049 | A | 6/1990 |
| JP | 02-265752 | A | 10/1990 |
| JP | 03-065348 | A | 3/1991 |
| JP | 03-112662 | A | 5/1991 |
| JP | 03-180350 | A | 8/1991 |
| JP | 04-118241 | A | 4/1992 |
| JP | 04-126255 | A | 4/1992 |
| JP | 04-141429 | A | 5/1992 |
| JP | 04-353458 | A | 12/1992 |
| JP | 04-368851 | A | 12/1992 |
| JP | 05-284765 | A | 10/1993 |
| JP | 05-318724 | A | 12/1993 |
| JP | 06-091865 | A | 4/1994 |
| JP | 06-091866 | A | 4/1994 |
| JP | 07-314665 | A | 12/1995 |
| WO | WO 94/18010 | A | 8/1994 |
| WO | WO 97/12689 | A | 4/1997 |

OTHER PUBLICATIONS

Noworolski J M et al: "Process for in-plane and out-of-plane single-crystal-silicon thermal microactuators" Sensors and Actuators A, Ch. Elsevier Sequoia S.A., Lausane, vol. 55, No. 1, Jul. 15, 1996, pp. 65-69, XP004077979.

Yamagata, Yutaka et al, "A Micro Mobile Mechanism Using Thermal Expansion and its Theoretical Analysis". Proceedings of the workshop on micro electro mechanical systems (MEMS), US, New York, IEEE, vol. Workshop 7, Jan. 25, 1994, pp. 142-147, XP000528408, ISBN: 0-7803-1834-X.

* cited by examiner

PRINTHEAD INTEGRATED CIRCUIT WITH MORE THAN 10000 NOZZLES

CROSS-REFERENCES TO RELATED APPLICATIONS

This is a Continuation-In-Part Application of U.S application Ser. No. 10/407,207 filed Apr. 7, 2003, now issued U.S. Pat. No. 7,252,366, which is a Continuation Application of U.S application Ser. No. 09/113,122 filed Jul. 10, 1998, now issued U.S. Pat. No. 6,557,977, all of which are herein incorporated by reference.

FIELD OF INVENTION

The present invention relates to the field of printing. In particular, the invention concerns an inkjet printhead for high resolution printing.

CROSS REFERENCE TO OTHER RELATED APPLICATIONS

The following applications have been filed by the Applicant simultaneously with this application:

| | | | | |
|---|---|---|---|---|
| 11/829,957 | 11/829,960 | 11/829,961 | 11/829,962 | 11/829,963 |
| 11/829,967 | 11/829,968 | 11/829,969 | | |

The disclosures of these co-pending applications are incorporated herein by reference.

The following patents or patent applications filed by the applicant or assignee of the present invention are hereby incorporated by cross-reference.

| | | | | | | |
|---|---|---|---|---|---|---|
| 6,405,055 | 6,628,430 | 7,136,186 | 10/920,372 | 7,145,689 | 7,130,075 | 7,081,974 |
| 7,177,055 | 7,209,257 | 7,161,715 | 7,154,632 | 7,158,258 | 7,148,993 | 7,075,684 |
| 11/635,526 | 11/650,545 | 11/653,241 | 11/653,240 | 11/758,648 | 7,241,005 | 7,108,437 |
| 6,915,140 | 6,999,206 | 7,136,198 | 7,092,130 | 09/517,539 | 6,566,858 | 6,331,946 |
| 6,246,970 | 6,442,525 | 09/517,384 | 09/505,951 | 6,374,354 | 7,246,098 | 6,816,968 |
| 6,757,832 | 6,334,190 | 6,745,331 | 09/517,541 | 10/203,559 | 7,197,642 | 7,093,139 |
| 10/636,263 | 10/636,283 | 10/866,608 | 7,210,038 | 10/902,833 | 10/940,653 | 10/942,858 |
| 11/706,329 | 11/757,385 | 11/758,642 | 7,170,652 | 6,967,750 | 6,995,876 | 7,099,051 |
| 11/107,942 | 7,193,734 | 11/209,711 | 11/599,336 | 7,095,533 | 6,914,686 | 7,161,709 |
| 7,099,033 | 11/003,786 | 11/003,616 | 11/003,418 | 11/003,334 | 11/003,600 | 11/003,404 |
| 11/003,419 | 11/003,700 | 11/003,601 | 11/003,618 | 7,229,148 | 11/003,337 | 11/003,698 |
| 11/003,420 | 6,984,017 | 11/003,699 | 11/071,473 | 11/748,482 | 11/778,563 | 11/779,851 |
| 11/778,574 | 11/003,463 | 11/003,701 | 11/003,683 | 11/003,614 | 11/003,702 | 11/003,684 |
| 11/003,619 | 11/003,617 | 11/764,760 | 11/293,800 | 11/293,802 | 11/293,801 | 11/293,808 |
| 11/293,809 | 11/482,975 | 11/482,970 | 11/482,968 | 11/482,972 | 11/482,971 | 11/482,969 |
| 11/097,266 | 11/097,267 | 11/685,084 | 11/685,086 | 11/685,090 | 11/740,925 | 11/763,444 |
| 11/763,443 | 11/518,238 | 11/518,280 | 11/518,244 | 11/518,243 | 11/518,242 | 11/084,237 |
| 11/084,240 | 11/084,238 | 11/357,296 | 11/357,298 | 11/357,297 | 11/246,676 | 11/246,677 |
| 11/246,678 | 11/246,679 | 11/246,680 | 11/246,681 | 11/246,714 | 11/246,713 | 11/246,689 |
| 11/246,671 | 11/246,670 | 11/246,669 | 11/246,704 | 11/246,710 | 11/246,688 | 11/246,716 |
| 11/246,715 | 11/246,707 | 11/246,706 | 11/246,705 | 11/246,708 | 11/246,693 | 11/246,692 |
| 11/246,696 | 11/246,695 | 11/246,694 | 11/482,958 | 11/482,955 | 11/482,962 | 11/482,963 |
| 11/482,956 | 11/482,954 | 11/482,974 | 11/482,957 | 11/482,987 | 11/482,959 | 11/482,960 |
| 11/482,961 | 11/482,964 | 11/482,965 | 11/482,976 | 11/482,973 | 11/495,815 | 11/495,816 |
| 11/495,817 | 6,227,652 | 6,213,588 | 6,213,589 | 6,231,163 | 6,247,795 | 6,394,581 |
| 6,244,691 | 6,257,704 | 6,416,168 | 6,220,694 | 6,257,705 | 6,247,794 | 6,234,610 |
| 6,247,793 | 6,264,306 | 6,241,342 | 6,247,792 | 6,264,307 | 6,254,220 | 6,234,611 |
| 6,302,528 | 6,283,582 | 6,239,821 | 6,338,547 | 6,247,796 | 6,557,977 | 6,390,603 |
| 6,362,843 | 6,293,653 | 6,312,107 | 6,227,653 | 6,234,609 | 6,238,040 | 6,188,415 |
| 6,227,654 | 6,209,989 | 6,247,791 | 6,336,710 | 6,217,153 | 6,416,167 | 6,243,113 |
| 6,283,581 | 6,247,790 | 6,260,953 | 6,267,469 | 6,588,882 | 6,742,873 | 6,918,655 |
| 6,547,371 | 6,938,989 | 6,598,964 | 6,923,526 | 6,273,544 | 6,309,048 | 6,420,196 |
| 6,443,558 | 6,439,689 | 6,378,989 | 6,848,181 | 6,634,735 | 6,299,289 | 6,299,290 |
| 6,425,654 | 6,902,255 | 6,623,101 | 6,406,129 | 6,505,916 | 6,457,809 | 6,550,895 |
| 6,457,812 | 7,152,962 | 6,428,133 | 7,216,956 | 7,080,895 | 11/144,844 | 7,182,437 |
| 11/599,341 | 11/635,533 | 11/607,976 | 11/607,975 | 11/607,999 | 11/607,980 | 11/607,979 |
| 11/607,978 | 11/735,961 | 11/685,074 | 11/696,126 | 11/696,144 | 11/696,650 | 11/763,446 |
| 10/407,212 | 10/407,207 | 10/683,064 | 10/683,041 | 11/766,713 | 11/482,980 | 11/563,684 |
| 11/432,967 | 11/482,966 | 11/482,988 | 11/432,989 | 11/293,832 | 11/293,838 | 11/293,825 |
| 11/293,841 | 11/293,799 | 11/293,796 | 11/293,797 | 11/293,798 | 11/124,158 | 11/124,196 |
| 11/124,199 | 11/124,162 | 11/124,202 | 11/124,197 | 11/124,154 | 11/124,198 | 11/124,153 |
| 11/124,151 | 11/124,160 | 11/124,192 | 11/124,175 | 11/124,163 | 11/124,149 | 11/124,152 |
| 11/124,173 | 11/124,155 | 7,236,271 | 11/124,174 | 11/124,194 | 11/124,164 | 11/124,200 |
| 11/124,195 | 11/124,166 | 11/124,150 | 11/124,172 | 11/124,165 | 11/124,186 | 11/124,185 |
| 11/124,184 | 11/124,182 | 11/124,201 | 11/124,171 | 11/124,181 | 11/124,161 | 11/124,156 |
| 11/124,191 | 11/124,159 | 11/124,176 | 11/124,188 | 11/124,170 | 11/124,187 | 11/124,189 |
| 11/124,190 | 11/124,180 | 11/124,193 | 11/124,183 | 11/124,178 | 11/124,177 | 11/124,148 |
| 11/124,168 | 11/124,167 | 11/124,179 | 11/124,169 | 11/187,976 | 11/188,011 | 11/188,014 |
| 11/482,979 | 11/735,490 | 11/228,540 | 11/228,500 | 11/228,501 | 11/228,530 | 11/228,490 |
| 11/228,531 | 11/228,504 | 11/228,533 | 11/228,502 | 11/228,507 | 11/228,482 | 11/228,505 |
| 11/228,497 | 11/228,487 | 11/228,529 | 11/228,484 | 11/228,489 | 11/228,518 | 11/228,536 |
| 11/228,496 | 11/228,488 | 11/228,506 | 11/228,516 | 11/228,526 | 11/228,539 | 11/228,538 |
| 11/228,524 | 11/228,523 | 11/228,519 | 11/228,528 | 11/228,527 | 11/228,525 | 11/228,520 |
| 11/228,498 | 11/228,511 | 11/228,522 | 11/228,515 | 11/228,537 | 11/228,534 | 11/228,491 |
| 11/228,499 | 11/228,509 | 11/228,492 | 11/228,493 | 11/228,510 | 11/228,508 | 11/228,512 |
| 11/228,514 | 11/228,494 | 11/228,495 | 11/228,486 | 11/228,481 | 11/228,477 | 11/228,485 |

-continued

| | | | | | | |
|---|---|---|---|---|---|---|
| 11/228,483 | 11/228,521 | 11/228,517 | 11/228,532 | 11/228,513 | 11/228,503 | 11/228,480 |
| 11/228,535 | 11/228,478 | 11/228,479 | 6,087,638 | 6,340,222 | 6,041,600 | 6,299,300 |
| 6,067,797 | 6,286,935 | 6,044,646 | 6,382,769 | 10/868,866 | 6,787,051 | 6,938,990 |
| 11/242,916 | 11/242,917 | 11/144,799 | 11/198,235 | 11/766,052 | 7,152,972 | 11/592,996 |
| 6,746,105 | 11/763,440 | 11/763,442 | 11/246,687 | 11/246,718 | 11/246,685 | 11/246,686 |
| 11/246,703 | 11/246,691 | 11/246,711 | 11/246,690 | 11/246,712 | 11/246,717 | 11/246,709 |
| 11/246,700 | 11/246,701 | 11/246,702 | 11/246,668 | 11/246,697 | 11/246,698 | 11/246,699 |
| 11/246,675 | 11/246,674 | 11/246,667 | 7,156,508 | 7,159,972 | 7,083,271 | 7,165,834 |
| 7,080,894 | 7,201,469 | 7,090,336 | 7,156,489 | 10/760,233 | 10/760,246 | 7,083,257 |
| 10/760,243 | 10/760,201 | 7,219,980 | 10/760,253 | 10/760,255 | 10/760,209 | 7,118,192 |
| 10/760,194 | 10/760,238 | 7,077,505 | 7,198,354 | 7,077,504 | 10/160,189 | 7,198,355 |
| 10/760,232 | 10/760,231 | 7,152,959 | 7,213,906 | 7,178,901 | 7,222,938 | 7,108,353 |
| 7,104,629 | 11/446,227 | 11/454,904 | 11/472,345 | 11/474,273 | 11/478,594 | 11/474,279 |
| 11/482,939 | 11/482,950 | 11/499,709 | 11/592,984 | 11/601,668 | 11/603,824 | 11/601,756 |
| 11/601,672 | 11/650,546 | 11/653,253 | 11/706,328 | 11/706,299 | 11/706,965 | 11/737,080 |
| 11/737,041 | 11/773,062 | 11/778,566 | 11/782,593 | 11/246,684 | 11/246,672 | 11/246,673 |
| 11/246,683 | 11/246,682 | 60/939,086 | 10/728,804 | 7,128,400 | 7,108,355 | 6,991,322 |
| 10/728,790 | 7,118,197 | 10/728,970 | 10/728,784 | 10/728,783 | 7,077,493 | 6,962,402 |
| 10/728,803 | 7,147,308 | 10/728,779 | 7,118,198 | 7,168,790 | 7,172,270 | 7,229,155 |
| 6,830,318 | 7,195,342 | 7,175,261 | 10/773,183 | 7,108,356 | 7,118,202 | 10/773,186 |
| 7,134,744 | 10/773,185 | 7,134,743 | 7,182,439 | 7,210,768 | 10/773,187 | 7,134,745 |
| 7,156,484 | 7,118,201 | 7,111,926 | 10/773,184 | 7,018,021 | 11/060,751 | 11/060,805 |
| 11/188,017 | 7,128,402 | 11/298,774 | 11/329,157 | 11/490,041 | 11/501,767 | 11/499,736 |
| 11/505,935 | 7,229,156 | 11/505,846 | 11/505,857 | 11/505,856 | 11/524,908 | 11/524,938 |
| 11/524,900 | 11/524,912 | 11/592,999 | 11/592,995 | 11/603,825 | 11/649,773 | 11/650,549 |
| 11/653,237 | 11/706,378 | 11/706,962 | 11/749,118 | 11/754,937 | 11/749,120 | 11/744,885 |
| 11/779,850 | 11/765,439 | 11/097,308 | 11/097,309 | 11/097,335 | 11/097,299 | 11/097,310 |
| 11/097,213 | 11/210,687 | 11/097,212 | 7,147,306 | 11/545,509 | 11/764,806 | 11/782,595 |
| 11/482,953 | 11/482,977 | 11/544,778 | 11/544,779 | 11/764,808 | 11/066,161 | 11/066,160 |
| 11/066,159 | 11/066,158 | 11/066,165 | 10/727,181 | 10/727,162 | 10/727,163 | 10/727,245 |
| 7,121,639 | 7,165,824 | 7,152,942 | 10/727,157 | 7,181,572 | 7,096,137 | 10/727,257 |
| 10/727,238 | 7,188,282 | 10/727,159 | 10/727,180 | 10/727,179 | 10/727,192 | 10/727,274 |
| 10/727,164 | 10/727,161 | 10/727,198 | 10/727,158 | 10/754,536 | 10/754,938 | 10/727,227 |
| 10/727,160 | 10/934,720 | 7,171,323 | 11/272,491 | 11/474,278 | 11/488,853 | 11/488,841 |
| 11/749,750 | 11/749,749 | 10/296,522 | 6,795,215 | 7,070,098 | 7,154,638 | 6,805,419 |
| 6,859,289 | 6,977,751 | 6,398,332 | 6,394,573 | 6,622,923 | 6,747,760 | 6,921,144 |
| 10/884,881 | 7,092,112 | 7,192,106 | 11/039,866 | 7,173,739 | 6,986,560 | 7,008,033 |
| 11/148,237 | 7,222,780 | 11/248,426 | 11/478,599 | 11/499,749 | 11/738,518 | 11/482,981 |
| 11/743,661 | 11/743,659 | 11/752,900 | 7,195,328 | 7,182,422 | 11/650,537 | 11/712,540 |
| 10/854,521 | 10/854,522 | 10/854,488 | 10/854,487 | 10/854,503 | 10/854,504 | 10/854,509 |
| 7,188,928 | 7,093,989 | 10/854,497 | 10/854,495 | 10/854,498 | 10/854,511 | 10/854,512 |
| 10/854,525 | 10/854,526 | 10/854,516 | 10/854,508 | 10/854,507 | 10/854,515 | 10/854,506 |
| 10/854,505 | 10/854,493 | 10/854,494 | 10/854,489 | 10/854,490 | 10/854,492 | 10/854,491 |
| 10/854,528 | 10/854,523 | 10/854,527 | 10/854,524 | 10/854,520 | 10/854,514 | 10/854,519 |
| 10/854,513 | 10/854,499 | 10/854,501 | 10/854,500 | 7,243,193 | 10/854,518 | 10/854,517 |
| 10/934,628 | 7,163,345 | 11/499,803 | 11/601,757 | 11/706,295 | 11/735,881 | 11/748,483 |
| 11/749,123 | 11/766,061 | 11/775,135 | 11/772,235 | 11/778,569 | 11/014,731 | 11/544,764 |
| 11/544,765 | 11/544,772 | 11/544,773 | 11/544,774 | 11/544,775 | 11/544,776 | 11/544,766 |
| 11/544,767 | 11/544,771 | 11/544,770 | 11/544,769 | 11/544,777 | 11/544,768 | 11/544,763 |
| 11/293,804 | 11/293,840 | 11/293,803 | 11/293,833 | 11/293,834 | 11/293,835 | 11/293,836 |
| 11/293,837 | 11/293,792 | 11/293,794 | 11/293,839 | 11/293,826 | 11/293,829 | 11/293,830 |
| 11/293,827 | 11/293,828 | 11/293,795 | 11/293,823 | 11/293,824 | 11/293,831 | 11/293,815 |
| 11/293,819 | 11/293,818 | 11/293,817 | 11/293,816 | 11/482,978 | 11/640,356 | 11/640,357 |
| 11/640,358 | 11/640,359 | 11/640,360 | 11/640,335 | 11/679,786 | 10/760,254 | 10/760,210 |
| 10/760,202 | 7,201,468 | 10/760,198 | 10/760,249 | 7,234,802 | 10/760,196 | 10/760,247 |
| 7,156,511 | 10/760,264 | 10/760,244 | 7,097,291 | 10/760,222 | 10/760,248 | 7,083,273 |
| 10/760,192 | 10/760,203 | 10/760,204 | 10/760,205 | 10/760,206 | 10/760,267 | 10/760,270 |
| 7,198,352 | 10/760,271 | 10/760,275 | 7,201,470 | 7,121,655 | 10/760,184 | 7,232,208 |
| 10/760,186 | 10/760,261 | 7,083,272 | 11/501,771 | 11/583,874 | 11/650,554 | 11/706,322 |
| 11/706,968 | 11/749,119 | 11/779,848 | 11/014,764 | 11/014,763 | 11/014,748 | 11/014,747 |
| 11/014,761 | 11/014,760 | 11/014,757 | 11/014,714 | 11/014,713 | 11/014,762 | 11/014,724 |
| 11/014,723 | 11/014,756 | 11/014,736 | 11/014,759 | 11/014,758 | 11/014,725 | 11/014,739 |
| 11/014,738 | 11/014,737 | 11/014,726 | 11/014,745 | 11/014,712 | 11/014,715 | 11/014,751 |
| 11/014,735 | 11/014,734 | 11/014,719 | 11/014,719 | 11/014,749 | 11/014,746 | 11/758,640 |
| 11/775,143 | 11/014,769 | 11/014,729 | 11/014,743 | 11/014,733 | 11/014,754 | 11/014,755 |
| 11/014,765 | 11/014,766 | 11/014,740 | 11/014,720 | 11/014,753 | 11/014,752 | 11/014,744 |
| 11/014,741 | 11/014,768 | 11/014,767 | 11/014,718 | 11/014,717 | 11/014,716 | 11/014,732 |
| 11/014,742 | 11/097,268 | 11/097,185 | 11/097,184 | 11/778,567 | 11/293,820 | 11/293,813 |
| 11/293,822 | 11/293,812 | 11/293,821 | 11/293,814 | 11/293,793 | 11/293,842 | 11/293,811 |
| 11/293,807 | 11/293,806 | 11/293,805 | 11/293,810 | 11/688,863 | 11/688,864 | 11/688,865 |
| 11/688,866 | 11/688,867 | 11/688,868 | 11/688,869 | 11/688,871 | 11/688,872 | 11/688,873 |
| 11/741,766 | 11/482,982 | 11/482,983 | 11/482,984 | 11/495,818 | 11/495,819 | 11/677,049 |
| 11/677,050 | 11/677,051 | 11/014,722 | 10/760,180 | 7,111,935 | 10/760,213 | 10/760,219 |
| 10/760,237 | 10/760,221 | 10/760,220 | 7,002,664 | 10/760,252 | 10/760,265 | 7,088,420 |
| 11/446,233 | 11/503,083 | 11/503,081 | 11/516,487 | 11/599,312 | 11/014,728 | 11/014,727 |
| 7,237,888 | 7,168,654 | 7,201,272 | 6,991,098 | 7,217,051 | 6,944,970 | 10/760,215 |
| 7,108,434 | 10/760,257 | 7,210,407 | 7,186,042 | 10/760,266 | 6,920,704 | 7,217,049 |
| 10/760,214 | 10/760,260 | 7,147,102 | 10/760,269 | 10/760,199 | 10/760,241 | 10/962,413 |
| 10/962,427 | 10/962,418 | 7,225,739 | 10/962,402 | 10/962,425 | 10/962,428 | 7,191,978 |

-continued

| | | | | | | |
|---|---|---|---|---|---|---|
| 10/962,426 | 10/962,409 | 10/962,417 | 10/962,403 | 7,163,287 | 10/962,522 | 10/962,523 |
| 10/962,524 | 10/962,410 | 7,195,412 | 7,207,670 | 11/282,768 | 7,220,072 | 11/474,267 |
| 11/544,547 | 11/585,925 | 11/593,000 | 11/706,298 | 11/706,296 | 11/706,327 | 11/730,760 |
| 11/730,407 | 11/730,787 | 11/733,977 | 11/736,527 | 11/753,566 | 11/754,359 | 11/778,061 |
| 11/765,398 | 11/778,556 | 11/780,470 | 11/223,262 | 11/223,018 | 11/223,114 | 11/223,022 |
| 11/223,021 | 11/223,020 | 11/223,019 | 11/114,730 | 7,079,292 | 09/575,197 | 7,079,712 |
| 09/575,123 | 6,825,945 | 09/575,165 | 6,813,039 | 6,987,506 | 7,038,797 | 6,980,318 |
| 6,816,274 | 7,102,772 | 09/575,186 | 6,681,045 | 6,728,000 | 7,173,722 | 7,088,459 |
| 09/575,181 | 7,068,382 | 7,062,651 | 6,789,194 | 6,789,191 | 6,644,642 | 6,502,614 |
| 6,622,999 | 6,669,385 | 6,549,935 | 6,987,573 | 6,727,996 | 6,591,884 | 6,439,706 |
| 6,760,119 | 09/575,198 | 6,290,349 | 6,428,155 | 6,785,016 | 6,870,966 | 6,822,639 |
| 6,737,591 | 7,055,739 | 7,233,320 | 6,830,196 | 6,832,717 | 6,957,768 | 09/575,172 |
| 7,170,499 | 7,106,888 | 7,123,239 | | | | |

BACKGROUND OF THE INVENTION

The quality of a printed image depends largely on the resolution of the printer. Accordingly, there are ongoing efforts to improve the print resolution of printers. The print resolution strictly depends on the spacing of the printer addressable locations on the media substrate and the drop volume. The spacing between nozzles on the printhead need not be as small as the spacing between addressable locations on the media substrate. The nozzle that prints a dot at one addressable location can be spaced any distance away from the nozzle that prints the dot at the adjacent addressable location. Movement of the printhead relative to the media, or vice versa, or both, will allow the printhead to eject drops at every addressable location regardless of the spacing between the nozzles on the printhead. In the extreme case, the same nozzle can print adjacent drops with the appropriate relative movement between the printhead and the media.

Excess movement of the media with respect to the printhead will reduce print speeds. Multiple passes of a scanning printhead over a single swathe of the media, or multiple passes of the media past the printhead in the case of pagewidth printhead reduces the page per minute print rate.

Alternatively, the nozzles can be spaced along the media feed path or in the scan direction so that the addressable locations on the media are smaller than the physical spacing of adjacent nozzles. It will be appreciated that the spacing the nozzles over a large section of the paper path or scan direction is counter to compact design. More importantly, it requires the paper feed to carefully control the media position and precise printer control of nozzle firing times.

For pagewidth printheads, the large nozzle array emphasizes the problem. Spacing the nozzles over a large section of the paper path requires the nozzle array to have a relatively large area. The nozzle array must, by definition, extend the width of the media. But its dimension in the direction of media feed should be as small as possible. Arrays that extend a relatively long distance in the media feed direction require complex print platens that maintain the spacing between the nozzles and the media surface across the entire array. Some printer designs use a broad vacuum platen opposite the printhead to get the necessary control of the media. In light of these issues, there is a strong motivation to increase the density of nozzles on the printhead (that is, the number of nozzles per unit area) in order to increase the addressable locations of the printer and therefore the print resolution while keeping the width of the array (in the direction of media feed) small.

SUMMARY OF THE INVENTION

Accordingly, the present invention provides a printhead for an inkjet printer, the printhead comprising:

an array of nozzles arranged in adjacent rows, each nozzle having an ejection aperture and a corresponding actuator for ejecting printing fluid through the ejection aperture, each actuator having electrodes spaced from each other in a direction transverse to the rows; and, drive circuitry for transmitting electrical power to the electrodes; wherein, the electrodes of the actuators in adjacent rows have opposing polarities such that the actuators in adjacent rows have opposing current flow directions.

By reversing the polarity of the electrodes in adjacent rows, the punctuations in the power plane of the CMOS can be kept to the outside edges of the adjacent rows. This moves one line of narrow resistive bridges between the punctuations to a position where the electrical current does not flow through them. This eliminates their resistance from the actuators drive circuit. By reducing the resistive losses for actuators remote from the power supply side of the printhead IC, the drop ejection characteristics are consistent across the entire array of nozzles.

Preferably, the electrodes in each row are offset from its adjacent actuators in a direction transverse to the row such that the electrodes of every second actuator are collinear. In a further preferred form, the offset is less than 40 microns. In a particularly preferred form, the offset is less than 30 microns. Preferably the array of nozzles is fabricated on an elongate wafer substrate extending parallel to the rows of the array, and the drive circuitry is CMOS layers on one surface of the wafer substrate, the CMOS layers being supplied with power and data along a long edge of the wafer substrate. In a further preferred form, the CMOS layers have a top metal layer forming a power plane that carries a positive voltage such that the electrodes having a negative voltage connect to vias formed in holes within the power plane. In another preferred form, the CMOS layers have a drive FET (field effect transistor) for each actuator in a bottom metal layer. Preferably, the CMOS layers have layers of metal less than 0.3 microns thick.

In some embodiments, the actuators are heater elements for generating a vapor bubble in the print fluid such that a drop of the printing fluid is ejected from the ejection aperture. Preferably, the heater elements are beams suspended between their respective electrodes such that they are immersed in the printing fluid. Preferably, the ejection apertures are elliptical with the major axis of the ejection aperture parallel to the longitudinal axis of the beam. In another preferred form, the major axes of the ejection apertures in one of the rows are respectively collinear with the major axes of the ejection apertures in the adjacent row such that each of the nozzles in one of the rows is aligned with one of the nozzles in the adjacent row. Preferably, the major axes of adjacent ejection apertures are spaced apart less than 50 microns. In a further preferred form, the major axes of adjacent ejection apertures are spaced apart less than 25 microns. In a particularly preferred form, the major axes of adjacent ejection apertures are spaced apart less than 16 microns.

In particular embodiments, the printhead has a nozzle pitch greater than 1600 nozzle per inch (npi) in a direction transverse to a media feed direction. In preferred embodiments, the nozzle pitch is greater than 3000 npi. In a particularly preferred embodiment, the printhead has a print resolution in dots per inch (dpi) that equals the nozzle pitch. In specific embodiments, the printhead is a pagewidth printhead configured for printing A4 sized media. Preferably, the printhead has more than 100,000 of the nozzles.

Accordingly, the present invention provides an inkjet printhead for a printer that can print onto a substrate at different print resolutions, the inkjet printhead comprising:

an array of nozzles, each nozzle having an ejection aperture and a corresponding actuator for ejecting print fluid through the ejection aperture; and, a print engine controller for sending print data to the array of nozzles; wherein, during use the print engine controller can selectively reduce the print resolution by apportioning print data for a single nozzle between at least two nozzles of the array.

The invention recognizes that some print jobs do not require the printhead's best resolution—a lower resolution is completely adequate for the purposes of the document being printed. This is particularly true if the printhead is capable of very high resolutions, say greater than 1200 dpi. By selecting a lower resolution, the print engine controller (PEC) can treat two or more transversely adjacent (but not necessarily contiguous) nozzles as a single virtual nozzle in a printhead with less nozzles. The print data is then shared between the adjacent nozzles—dots required from the virtual nozzle are printed by each of the actual nozzles in turn. This serves to extend the operational life of all the nozzles.

Preferably, the two nozzles are positioned in the array such that they are nearest neighbours in a direction transverse to the movement of the printhead relative to the substrate. Preferably, the PEC shares the print data equally between the two nozzles in the array. In a further preferred form, the two nozzles are spaced at less than 20 micron centres. In a particularly preferred form, the printhead is a pagewidth printhead and the two nozzles are spaced in a direction transverse to the media feed direction at less than 16 micron centres. In a specific embodiments, the two nozzles are spaced in a direction transverse to the media feed direction at less than 8 micron centres. In particular embodiments, the printhead has a nozzle pitch greater than 1600 nozzle per inch (npi) in a direction transverse to a media feed direction. In preferred embodiments, the nozzle pitch is greater than 3000 npi. In a particularly preferred embodiment, the printhead has a print resolution in dots per inch (dpi) that equals the nozzle pitch. In specific embodiments, the printhead is configured for printing A4 sized media and the printhead has more than 100,000 of the nozzles.

In some embodiments, the printer operates at an increased print speed when printing at the reduced print resolution. Preferably, the increased print speed is greater than 60 pages per minute. In preferred forms, the PEC halftones, the color plane printed by the adjacent nozzles with a dither matrix optimized for the transverse shift of every drop ejected.

Accordingly, the present invention provides an inkjet printhead comprising:

an array of nozzles arranged in adjacent rows, each nozzle having an ejection aperture, a chamber for containing printing fluid and a corresponding actuator for ejecting the printing fluid through the ejection aperture, each of the chambers having a respective inlet to refill the printing fluid ejected by the actuator; and, a printing fluid supply channel extending parallel to the adjacent rows for supplying printing fluid to the actuator of each nozzle in the array via the respective inlets; wherein, the inlets of nozzle in one of the adjacent rows configured for a refill flowrate that differs from the refill flowrate through the inlets of nozzles in another of the adjacent rows.

The invention configures the nozzle array so that several rows are filled from one side of an ink supply channel. This allows a greater density of nozzles on the printhead surface because the supply channel is not supplying just one row of nozzles along each side. However, the flowrate through the inlets is different for each row so that rows further from the supply channel do not have significantly longer refill times.

Preferably, the inlets of nozzles in one of the adjacent rows configured for a refill flowrate that differs from the refill flowrate through the inlets of nozzles in another of the adjacent rows such that the chamber refill time is substantially uniform for all the nozzles in the array. In a further preferred form, the inlets of the row closets the supply channel are narrower than the rows further from the supply channel. In some embodiments, there are two adjacent rows of nozzles on either side of the supply channel.

Preferably, the inlets have flow damping formations. In a particularly preferred form, the flow damping formation is a column positioned such that it creates a flow obstruction, the columns in the inlets of one row creating a different degree of obstruction to the columns is the inlets of the other row. Preferably, the columns create a bubble trap between the column sides and the inlet sidewalls. Preferably, the columns diffuse pressure pulses in the printing fluid to reduce cross talk between the nozzles.

In some embodiments, the actuators are heater elements for generating a vapor bubble in the printing fluid such that a drop of the printing fluid is ejected from the ejection aperture. Preferably, the heater elements are beams suspended between their respective electrodes such that they are immersed in the printing fluid. Preferably, the ejection apertures are elliptical with the major axis of the ejection aperture parallel to the longitudinal axis of the beam. Preferably, the major axes of adjacent ejection apertures are spaced apart less than 50 microns. In a further preferred form, the major axes of adjacent ejection apertures are spaced apart less than 25 microns. In a particularly preferred form, the major axes of adjacent ejection apertures are spaced apart less than 16 microns.

In particular embodiments, the printhead has a nozzle pitch greater than 1600 nozzle per inch (npi) in a direction transverse to a media feed direction. In preferred embodiments, the nozzle pitch is greater than 3000 npi. In a particularly preferred embodiment, the printhead has a print resolution in dots per inch (dpi) that equals the nozzle pitch. In specific embodiments, the printhead is a pagewidth printhead configured for printing A4 sized media. Preferably, the printhead has more than 100,000 of the nozzles.

Accordingly, the present invention provides an inkjet printhead comprising:

an array of nozzles arranged in a series of rows, each nozzle having an ejection aperture, a chamber for holding printing fluid and a heater element for generating a vapor bubble in the printing fluid contained by the chamber to eject a drop of the printing fluid through the ejection aperture; wherein, the nozzle, the heater element and the chamber are all elongate structures that have a long dimension that exceeds their other dimensions respectively; and, the respective long dimension of the nozzle, the heater element and the chambers are parallel and extend normal to the row direction.

To increase the nozzle density of the array, each of the nozzle components—the chamber, the ejection aperture and the heater element are configured as elongate structures that are all aligned transverse to the direction of the row. This raises the nozzle pitch, or nozzle per inch (npi), of the row while allowing the chamber volume and therefore drop volume to stay large enough for a suitable color density. It also avoids the need to spread the over a large distance in the paper feed direction (in the case of pagewidth printers) or in the scanning direction (in the case of scanning printheads).

Preferably, each of the rows in the array is offset with respect to it adjacent row such that not of the long dimensions of the nozzles in one row are not collinear with any of the long dimension so the adjacent row. In a further preferred form the printhead is a pagewidth printhead for printing to a media substrate fed past the printhead in a media feed direction such that the long dimensions of the nozzles are parallel wit the media feed direction.

Preferably, the long dimensions of the nozzles in every second are in registration. In a particularly preferred form the ejection apertures for all the nozzles is formed in a planar roof layer that partially defines the chamber, the roof layer having an exterior surface that is flat with the exception of the ejection apertures. In a particularly preferred form, the array of nozzles is formed on an underlying substrate extending parallel to the roof layer and the chamber is partially defined by a sidewall extending between the roof layer and the substrate, the side wall being shaped such that its interior surface is at least partially elliptical. Preferably, the sidewall is elliptical except for an inlet opening for the printing fluid. In a particularly preferred form, the minor axes of the nozzles in one of the rows partially overlaps with the minor axes of the nozzles in the adjacent row with respect to the media feed direction. In a further preferred form, the ejection apertures are elliptical.

Preferably, the heater elements are beams suspended between their respective electrodes such that, during use, they are immersed in the printing fluid. Preferably, the vapor bubble generated by the heater element is approximately elliptical in a cross section parallel to the ejection aperture.

In some embodiments, the printhead further comprises a supply channel adjacent the array extending parallel to the rows. In a preferred form, the array of nozzles is a first array of nozzles and a second array of nozzles is formed on the other side of the supply channel, the second array being a minor image of the first array but offset with respect to the first array such that none of the major axes of the ejection apertures in the first array are collinear with any of the major axes of the second array. Preferably, the major axes of ejection apertures in the first array are offset from the major axes of the ejection apertures in the second array in a direction transverse to the media feed direction by less than 20 microns. In a particularly preferred form, the offset is approximately 8 microns. In some embodiments, the printhead has a nozzle pitch in the direction transverse to the direction of media feed greater than 1600 npi. In a particularly preferred form, the substrate is less than 3 mm wide in the direction of media feed.

Accordingly, the present invention provides an inkjet printhead comprising:

an array of nozzles for ejecting drops of printing fluid onto print media when the print media and moved in a print direction relative to the printhead; wherein, the nozzles in the array are spaced apart from each other by less than 10 microns in the direction perpendicular to the print direction.

With nozzles spaced less than 10 microns apart in the direction perpendicular to the print direction, the printhead has a very high 'true' print resolution—i.e. the high number of dots per inch is achieved by a high number of nozzles per inch.

Preferably, the nozzles i the array that are spaced apart from each other by less than 10 microns in the direction perpendicular to the print direction, are also spaced apart from each other in the print direction by less than 150 microns.

In a further preferred form, the array has more than 700 of the nozzles per square millimeter.

Preferably, the array of nozzles is supported on a plurality of monolithic wafer substrates, each monolithic wafer substrate supporting more than 10000 of the nozzles. In a further preferred form, each monolithic wafer substrate supports more than 12000 of the nozzles. In a particularly preferred form, the plurality of monolithic wafer substrates are mounted end to end to form a pagewidth printhead for mounting is a printer configured to feed media past the printhead is a media feed direction, the printhead having more than 100000 of the nozzles and extends in a direction transverse to the media feed direction between 200 mm and 330 mm. In some embodiments, the array has more than 140000 of the nozzles.

Optionally, the printhead further comprises a plurality of actuators for each of the nozzles respectively, the actuators being arranged in adjacent rows, each having electrodes spaced from each other in a direction transverse to the rows for connection to respective drive transistors and a power supply; wherein, the electrodes of the actuators in adjacent rows have opposing polarities such that the actuators in adjacent rows have opposing current flow directions. Preferably, the electrodes in each row are offset from its adjacent actuators in a direction transverse to the row such that the electrodes of every second actuator are collinear. In particularly preferred embodiments, the droplet ejectors are fabricated on an alongate wafer substrate extending parallel to the rows of the actuators, and power and data supplied along a long edge of the wafer substrate.

In some embodiments, the printhead has a print engine controller (PEC) for sending print data to the array of nozzles; wherein, during use the print engine controller can selectively reduce the print resolution by apportioning print data for a single nozzle between at least two nozzles of the array. Preferably, the two nozzles are positioned in the array such that they are nearest neighbours in a direction transverse to the movement of the printhead relative to a print media substrate. In a particularly preferred form, the PEC shares the print data equality between the two nozzles in the array. Preferably, the two nozzles are spaced at less than 40 micron centers.

In a particularly preferred form, the printhead is a pagewidth printhead and the two nozzles are spaced in a direction transverse to the media feed direction at less than 16 micron centers. Preferably, the adjacent nozzles are spaced in a direction transverse to the media feed direction at less than 8 micron centers. Preferably, the printhead has a nozzle pitch greater than 1600 nozzle per inch (npi) in a direction transverse to a media feed direction. In a further preferred form, the nozzle pitch is greater than 3000 npi.

Accordingly, the present invention provides a printhead integrated circuit for an inkjet printhead, the printhead integrated circuit comprising:

a monolithic wafer substrate supporting an array of droplet ejectors for ejecting drops of printing fluid onto print media, each drop ejector having a nozzle and an actuator for ejecting a drop of printing fluid through the nozzle; wherein, the array has more than 10000 of the droplet ejectors.

With a large number of droplet ejectors fabricated on a single wafer, the nozzle array has a high nozzle pitch and the printhead has a very high 'true' print resolution—i.e. the high number of dots per inch is achieved by a high number of nozzles per inch.

Preferably, the array has more than 12000 of the droplet ejectors. In a further preferred form, the print media moves in a print direction relative to the printhead and the nozzles in the array are spaced apart from each other by less than 10 microns in the direction perpendicular to the print direction. In a particularly preferred form, the nozzles in the array that are spaced apart from each other by less than 10 microns in the direction perpendicular to the print direction, are also spaced apart from each other in the print direction by less than 150 microns.

In a preferred embodiment, the array has more than 700 of the droplet ejectors per square millimeter. In a particularly preferred form, the actuators are arranged in adjacent rows, each having electrodes spaced from each other in a direction transverse to the rows for connection to respective drive transistors and a power supply, the electrodes of the actuators in adjacent rows having opposing polarities such that the actuators in adjacent rows have opposing current flow directions. In a still further preferred form, the electrodes in each row are offset from their adjacent actuators in a direction transverse to the row such that the electrodes of every second actuator are collinear.

In specific embodiments, the monolithic wafer substrate is elongate and extends parallel to the rows of the actuators, such that in use power and data is supplied along a long edge of the wafer substrate. In some forms, the inkjet printhead comprises a plurality of the printhead integrated circuits, and further comprises a print engine controller (PEC) for sending print data to the array of droplet ejectors wherein during use the print engine controller can selectively reduce the print resolution by apportioning print data for a single droplet ejector between at least two droplet ejectors of the array. Preferably, the two nozzles are positioned in the array such that they are nearest neighbours in a direction transverse to the movement of the printhead relative to a print media substrate. In a particularly preferred form, the PEC shares the print data equally between the two nozzles in the array. Optionally, the two nozzles are spaced at less than 40 micron centers. In particularly preferred embodiments, the printhead is a pagewidth printhead and the two nozzles are spaced in a direction transverse to the media feed direction at less than 16 micron centers. In a still further preferred form, the adjacent nozzles are spaced in a direction transverse to the media feed direction at less than 8 micron centers.

In some embodiments, the inkjet printhead comprises a plurality of the printhead integrated circuits mounted end to end to form a pagewidth printhead for a printer configured to feed media past the printhead is a media feed direction, the printhead having more than 100000 of the nozzles are extends in a direction transverse to the media feed direction between 200 mm and 330 mm. In a further preferred form the array has more than 140000 of the nozzles.

Preferably, the array of droplet ejectors has a nozzle pitch greater than 1600 nozzle per inch (npi) in a direction transverse to a media feed direction, and preferably the nozzle pitch is greater than 3000 npi.

Accordingly, the present invention provides a printhead integrated circuit (IC) for an inkjet printhead, the printhead IC comprising:

a planar array of droplet ejectors, each having data distribution circuitry, a drive transistor, a printing fluid inlet, an actuator, a chamber and a nozzle, the chamber being configured to hold printing fluid adjacent the nozzle such that during use, the drive transistor activates the actuator to eject a droplet of the printing fluid through the nozzle; wherein, the array has more than 700 of the droplet ejectors per square millimeter.

With a high density of droplet ejectors fabricated on a wafer substrate, the nozzle array has a high nozzle pitch and the printhead has a very high 'true' print resolution—i.e. the high number of dots per inch is achieved by a high number of nozzles per inch.

Preferably, the array ejects drops of printing fluid onto print media when the print media and moved in a print direction relative to the printhead, and the nozzles in the array are spaced apart from each other by less than 10 microns in the direction perpendicular to the print direction. In a further preferred form, the nozzles that are spaced apart from each other by less than 10 microns in the direction perpendicular to the print direction, are also spaced apart from each other in the print direction by less than 150 microns.

In specific embodiments of the invention, a plurality of the printhead ICs are used in an inkjet printhead, each printhead IC having more than 10000 of the droplet ejectors, and preferably more than 12000 of the nozzle unit cells.

In some embodiments, the printhead ICs are elongate and mounted end to end such that the printhead has more than 100000 of the droplet ejectors and extends in a direction transverse to the media feed direction between 200 mm and 330 mm. In a further preferred form, the printhead has more than 140000 of the droplet ejectors.

In some preferred forms, the actuators are arranged in adjacent rows, each having electrodes spaced from each other in a direction transverse to the rows for connection to the corresponding drive transistor and a power supply; wherein, the electrodes of the actuators in adjacent rows have opposing polarities such that the actuators in adjacent rows have opposing current flow directions.

Preferably, in these embodiments, the electrodes in each row are offset from its adjacent actuators in a direction transverse to the row such that the electrodes of every second actuator are collinear. In further preferred forms, the elongate wafer substrate extends parallel to the rows of the actuators, and power and data supplied along a long edge of the wafer substrate.

In specific embodiments, the printhead has a print engine controller (PEC) for sending print data to the array of nozzles; wherein, during use the print engine controller can selectively reduce the print resolution by apportioning print data for a single nozzle between at least two nozzles of the array.

Preferably, the two nozzles are positioned in the array such that they are nearest neighbours in a direction transverse to the movement of the printhead relative to a print media substrate. In a further preferred form, the PEC shares the print data equality between the two nozzles in the array. Preferably, the two nozzles are spaced at less than 40 micron centers. In a particularly preferred form, the printhead is a pagewidth printhead and the two nozzles are spaced in a direction transverse to the media feed direction at less than 16 micron centers. In a still further preferred form, the adjacent nozzles are spaced in a direction transverse to the media feed direction at less than 8 micron centers.

In some forms, the printhead has a nozzle pitch greater than 1600 nozzle per inch (npi) in a direction transverse to a media feed direction. Preferably, the nozzle pitch is greater than 3000 npi.

Accordingly, the present invention provides a pagewidth inkjet printhead comprising:

an array of droplet ejectors for ejecting drops of printing fluid onto print media fed passed the printhead in a media feed direction, each drop ejector having a nozzle and an actuator for ejecting a drop of printing fluid through the nozzle; wherein, the array has more than 100000 of the droplet ejectors and extends in a direction transverse to the media feed direct between 200 mm and 300 mm.

A pagewidth printhead with a large number of nozzles extending the width of the media provides a high nozzle pitch and a very high 'true' print resolution—i.e. the high number of dots per inch is achieved by a high number of nozzles per inch.

Preferably, the array has more than 140000 of the droplet ejectors. In a further preferred form, the nozzles are spaced apart from each other by less than 10 microns in the direction perpendicular to the media feed direction. In a particularly preferred form, the nozzles that are spaced apart from each other by less than 10 microns in the direction perpendicular to the media feed direction, are also spaced apart from each other in the media feed direction by less than 150 microns.

In specific embodiments, the array of droplet ejectors is supposed on a plurality of monolithic wafer substrates, each monolithic wafer substrate supporting more than 1000 of the droplet ejectors, and preferably more than 12000 of the droplet ejectors. In these embodiments, it is desirable that the array has more than 700 of the droplet ejectors per square millimeter.

Optionally, the actuators are arranged in adjacent rows, each having electrodes spaced from each other in a direction transverse to the rows for connection to respective drive transistors and a power supply; wherein, the electrodes of the actuators in adjacent rows have opposing polarities such that the actuators in adjacent rows have opposing current flow directions. Preferably the electrodes in each row are offset from its adjacent actuators in a direction transverse to the row such that the electrodes of every second actuator are collinear. In particularly preferred embodiments, the droplet ejectors are fabricated on an elongate wafer substrate extending parallel to the rows of the actuators, and power and data supplied along a long edge of the wafer substrate.

In some embodiments, the printhead has a print engine controller (PEC) for sending print data to the array of nozzles; wherein, during use the print engine controller can selectively reduce the print resolution by apportioning print data for a single nozzle between at least two nozzles of the array. Preferably, the two nozzles are positioned in the array such that they are nearest neighbours in a direction transverse to the movement of the printhead relative to a print media substrate. In a particularly preferred form, the PEC shares the print data equally between the two nozzles in the array. Preferably, the two nozzles are spaced at less than 40 micron centers.

In a particularly preferred form, the printhead is a pagewidth printhead and the two nozzles are spaced in a direction transverse to the media feed direction at less than 16 micron centers. Preferably, the adjacent nozzles are spaced in a direction transverse to the media feed direction at less than 8 micron centers. Preferably, the printhead has a nozzle pitch greater than 1600 nozzle per inch (npi) in a direction transverse to a media feed direction. In a further preferred form, the nozzle pitch is greater than 3000 npi.

Accordingly, the present invention provides a printhead integrated circuit for an inkjet printer, the printhead integrated circuit comprising:

a monolithic wafer substrate supporting an array of droplet ejectors for ejecting drops of printing fluid onto print media, each droplet ejector having nozzle and an actuator for ejecting a drop of printing fluid the nozzle, the array being formed on the monolithic wafer substrate by a succession of photolithographic etching and deposition steps involving a photo-imaging device that exposes an exposure area to light focused to project a pattern onto the monolithic substrate; wherein, the array has more than 10000 of the droplet ejectors configured to be encompassed by the exposure area.

The invention arranges the nozzle array such that the droplet ejector density is very high and the number of exposure steps required is reduced.

Preferably the exposure area is less than 900 $mm^2$. Preferably, the monolithic wafer substrate is encompassed by the exposure area. In a further preferred form the photo-imaging device is a stepper that exposes an entire reticle simultaneously. Optionally, the photo-imaging device is a scanner that scans a narrow band of light across the exposure area to expose the reticle.

Preferably, the monolithic wafer substrate supports more than 12000 of the droplet ejectors. In these embodiments, it is desirable that the array has more than 700 of the droplet ejectors per square millimeter.

In some embodiments, the printhead IC is assembled onto a pagewidth printhead with other like printhead ICs, for ejecting drops of printing fluid onto print media fed passed the printhead in a media feed direction, wherein, the printhead has ore than 100000 of the droplet ejectors and extends in a direction transverse to the media feed direct between 200 mm and 330 mm. In a further preferred form, the nozzles are spaced apart from each other by less than 10 microns in the direction perpendicular to the media feed direction. Preferably, the printhead has more than 140000 of the droplet ejectors. In a particularly preferred form, the nozzles that are spaced apart from each other by less than 10 microns in the direction perpendicular to the media feed direction, are also spaced apart from each other in the media feed direction by less than 150 microns.

Optionally, the actuators are arranged in adjacent rows, each having electrodes spaced from each other in a direction transverse to the rows for connection to respective drive transistors and a power supply; wherein, the electrodes of the actuators in adjacent rows have opposing polarities such that the actuators in adjacent rows have opposing current flow directions. Preferably the electrodes in each row are offset from its adjacent actuators in a direction transverse to the row such that the electrodes of every second actuator are collinear. In particularly preferred embodiments, the droplet ejectors are fabricated on an elongate wafer substrate extending parallel to the rows of the actuators, and power and data supplied along a long edge of the wafer substrate.

In some embodiments, the printhead has a print engine controller (PEC) for sending print data to the array of nozzles; wherein, during use the print engine controller can selectively reduce the print resolution by apportioning print data for a single nozzle between at least two nozzles of the array. Preferably, the two nozzles are positioned in the array such that they are nearest neighbours in a direction transverse to the movement of the printhead relative to a print media substrate. In a particularly preferred form, the PEC shares the print data equally between the two nozzles in the array. Preferably, the two nozzles are spaced at less than 40 micron centers.

In a particularly preferred form, the printhead is a pagewidth printhead and the two nozzles are spaced in a direction transverse to the media feed direction at less than 16 micron centers. Preferably, the adjacent nozzles are spaced in a direction transverse to the media feed direction at less than 8 micron centers. Preferably, the printhead has a nozzle pitch greater than 1600 nozzle per inch (npi) in a direction transverse to a media feed direction. In a further preferred form, the nozzle pitch is greater than 3000 npi.

BRIEF DESCRIPTION OF THE DRAWINGS

Preferred embodiments of the invention will now be described by way of example only with reference to the accompanying drawings, in which.

DETAILED DESCRIPTION OF THE PREFERRED EMBODIMENTS

The printhead IC (integrated circuit) shown in the accompanying drawings is fabricated using the same lithographic etching and deposition steps described in the U.S. Ser. No. 11/246,687 filed 11 Oct. 2005, the contents of which are incorporated hereby reference. The ordinary worker will understand that the printhead IC shown in the accompanying drawings have a chamber, nozzle and heater electrode configuration that requires the use of exposure masks that differ from those shown in U.S. Ser. No. 11/246,687 filed 11 Oct. 2005 Figures. However the process steps of forming the suspended beam heater elements, chambers and ejection apertures remains the same. Likewise, the CMOS layers are formed in the same manner as that discussed U.S. Ser. No. 11/246,687 filed 11 Oct. 2005 with the exception of the drive FETs. The drive FETs need to be similar because the higher density of the heater elements.

Linking Printhead Integrated Circuits

The Applicant has developed a range of printhead devices that use a series of printhead integrated circuits (ICs) that link together to form a pagewidth printhead. In this way, the printhead IC's can be assembled into printheads used in applications ranging from wide format printing to camera and cellphones with inbuilt printers. The printhead IC's are mounted end-to-end on a support member to form a pagewidth printhead. The support member mounts the printhead IC's in the printer and also distributes ink to the individual IC's. An example of this type of printhead is described in U.S. Ser. No. 11/293,820, the disclosure of which is incorporated herein by cross reference.

It will be appreciated that any reference to the term 'ink' is to be interpreted as any printing fluid unless it is clear from the context that it is only a colorant for imaging print media. The printhead IC's can equally eject invisible inks, adhesives, medicaments or other functionalized fluids.

Figure 1A:
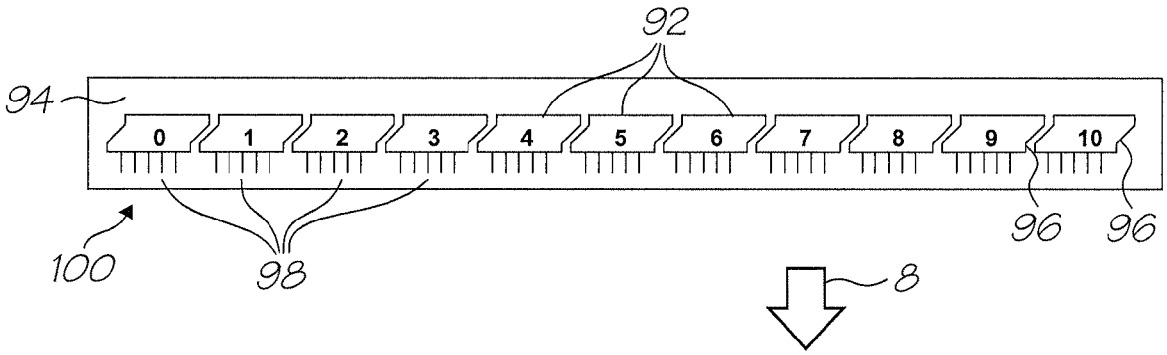
FIG. 1A is a schematic representation of the linking printhead IC construction.

FIG. 1A shows a sketch of a pagewidth printhead 100 with the series of printhead ICs 92 mounted to a support member 94. The angled sides 96 allow the nozzles from one of the IC's 92 overlap with those of an adjacent IC in the paper feed direction 8. Overlapping the nozzles in each IC 92 provides continuous printing across the junction between the IC's. This avoids any 'banding' in the resulting print. Linking individual printhead IC's in this manner allows printheads of any desired length to be made by simply using different numbers of IC's.

The end to end arrangement of the printhead ICs 92 requires the power and data to be supplied to bond pads 92 along the long sides of each printhead IC 92. These connections, and the control of the linking ICs with a print engine controller (PEC), is described in detail in Ser. No. 11/544,764 filed 10 Oct. 2006.

3600 DPI Printhead Overview

Figure 1B:
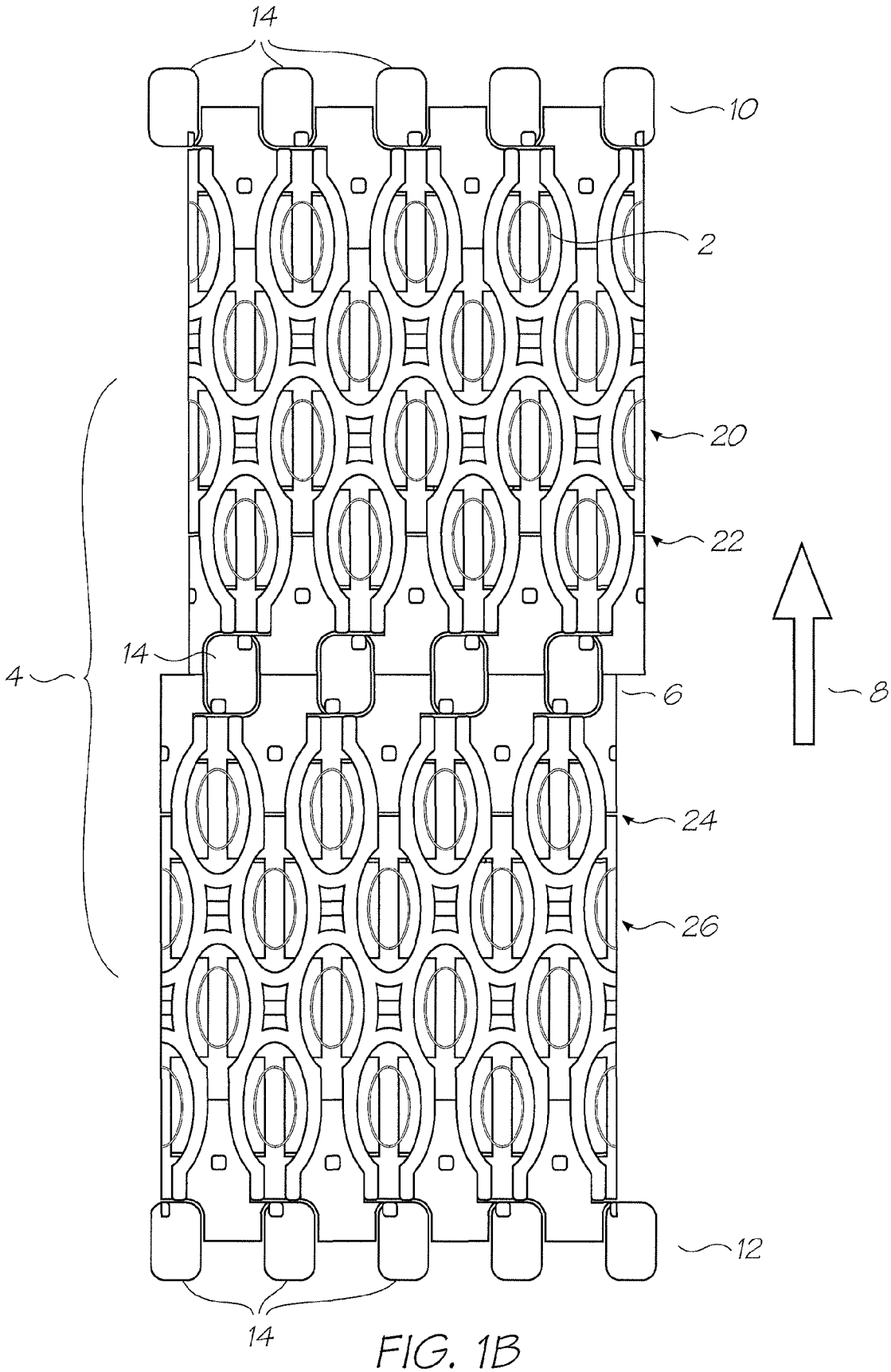
FIG. 1B shows a partial plan view of the nozzle array on a printhead IC according to the present invention.
Figure 2:
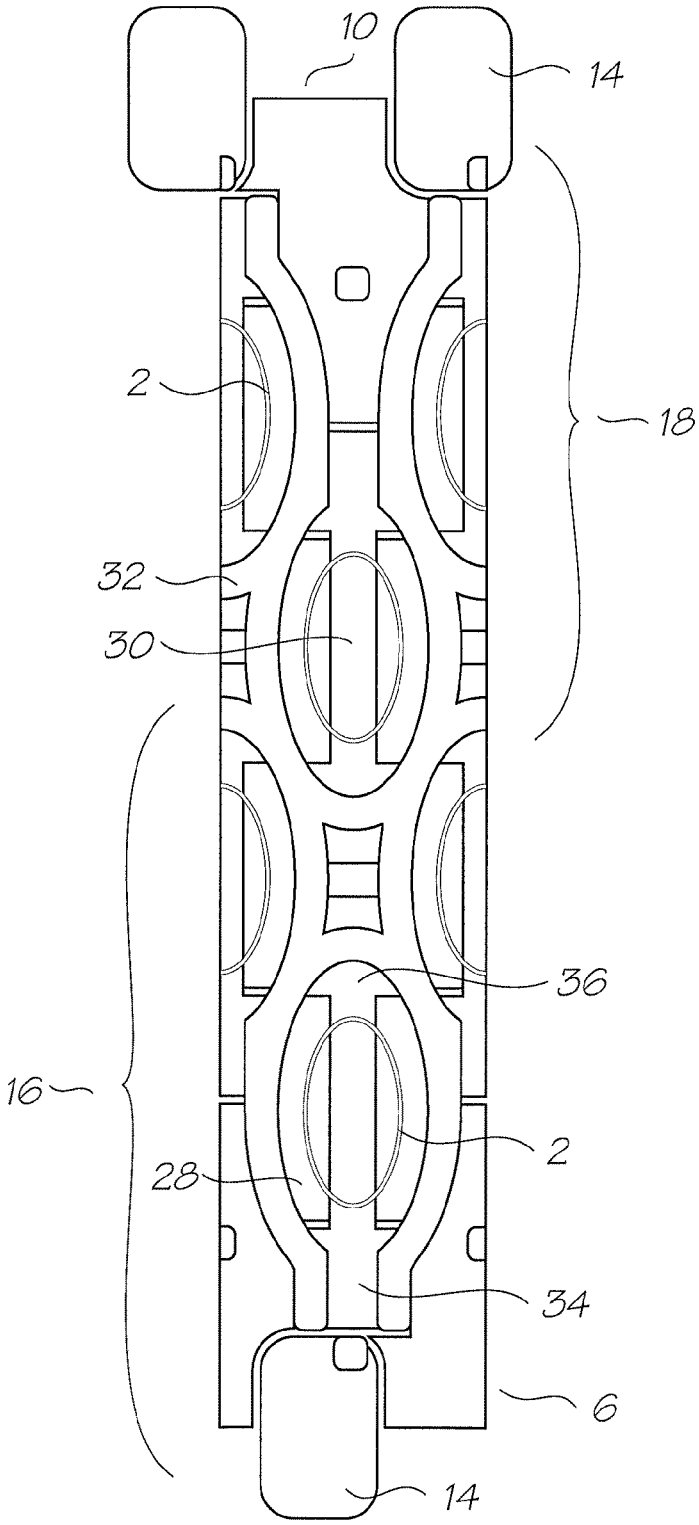
FIG. 2 is a unit cell of the nozzle array.

FIG. 1B shows a section of the nozzle array of the Applicants recently developed 3200 dpi printhead. The printhead has 'true' 3200 dpi resolution in that the nozzle pitch is 3200 npi rather than a printer with 3200 dpi addressable locations and a nozzle pitch less than 3200 npi. The section shown in FIG. 1B shows eight unit cells of the nozzle array with the roof layer removed. For the purposes of illustration, the ejection apertures 2 have been shown in outline. The 'unit cell' is the smallest repeating unit of the nozzle array and has two complete droplet ejectors and four halves of the droplet ejectors on either side of the complete ejectors. A single unit cell is shown in FIG. 2.

The nozzle rows extend transverse to the media feed direction 8. The middle four rows of nozzles are one color channel 4. Two rows extend either side of the ink supply channel 6. Ink from the opposing side of the wafer flows to the supply channel 6 through the ink feed conduits 14. The upper and lower ink supply channels 10 and 12 are separate color channels (although for greater color density they may print the same color ink—eg a CCMMY printhead).

Rows 20 and 22 above the supply channel 6 are transversely offset with respect to the media feed direction 8. Below the ink supply channel 6, rows 24 and 26 are similarly offset along the width of the media. Furthermore, rows 20 and 22, and rows 24 and 26 are mutually offset with respect to each other. Accordingly, the combined nozzle pitch of rows 20 to 26 transverse to the media feed direction 8 is one quarter the nozzle pitch of any of the individual rows. The nozzle pitch along each row is approximately 32 microns (nominally 31.75 microns) and therefore the combined nozzle pitch for all the rows in one color channel is approximately 8 microns (nominally 7.9375 microns). This equates to a nozzle pitch of 3200 npi and hence the printhead has 'true' 3200 dpi resolution.

Unit Cell

FIG. 2 is a single unit cell of the nozzle array. Each unit cell has the equivalent of four droplet ejectors (two complete droplet ejectors and four halves of the droplet ejectors on both sides of the complete ejectors). The droplet ejectors are the nozzle, the chamber, drive FET and drive circuitry for a single MEMS fluid ejection device. The ordinary worker will appreciate that the droplet ejectors are often simply referred to as nozzles for convenience but it is understood from the context of use whether this term is a reference to just the ejection aperture of the entire MEMS device.

The top two nozzle rows 18 are fed from the ink feed conduits 14 via the top ink supply channel 10. The bottom nozzle rows 16 are a different color channel fed from the supply channel 6. Each nozzle has an associated chamber 28 and heater element 30 extending between electrodes 34 and 36. The chambers 28 are elliptical and offset from each other so that their minor axes overlap transverse to the media feed direction. This configuration allows the chamber volume, nozzle area and heater size to be substantially the same as the 1600 dpi printheads shown in the above referenced U.S. Ser. No. 11/246,687 filed 11 Oct. 2005. Likewise the chamber walls 32 remain 4 microns thick and the area of the contacts 34 and 36 are still 10 microns by 10 microns.

Figure 3:
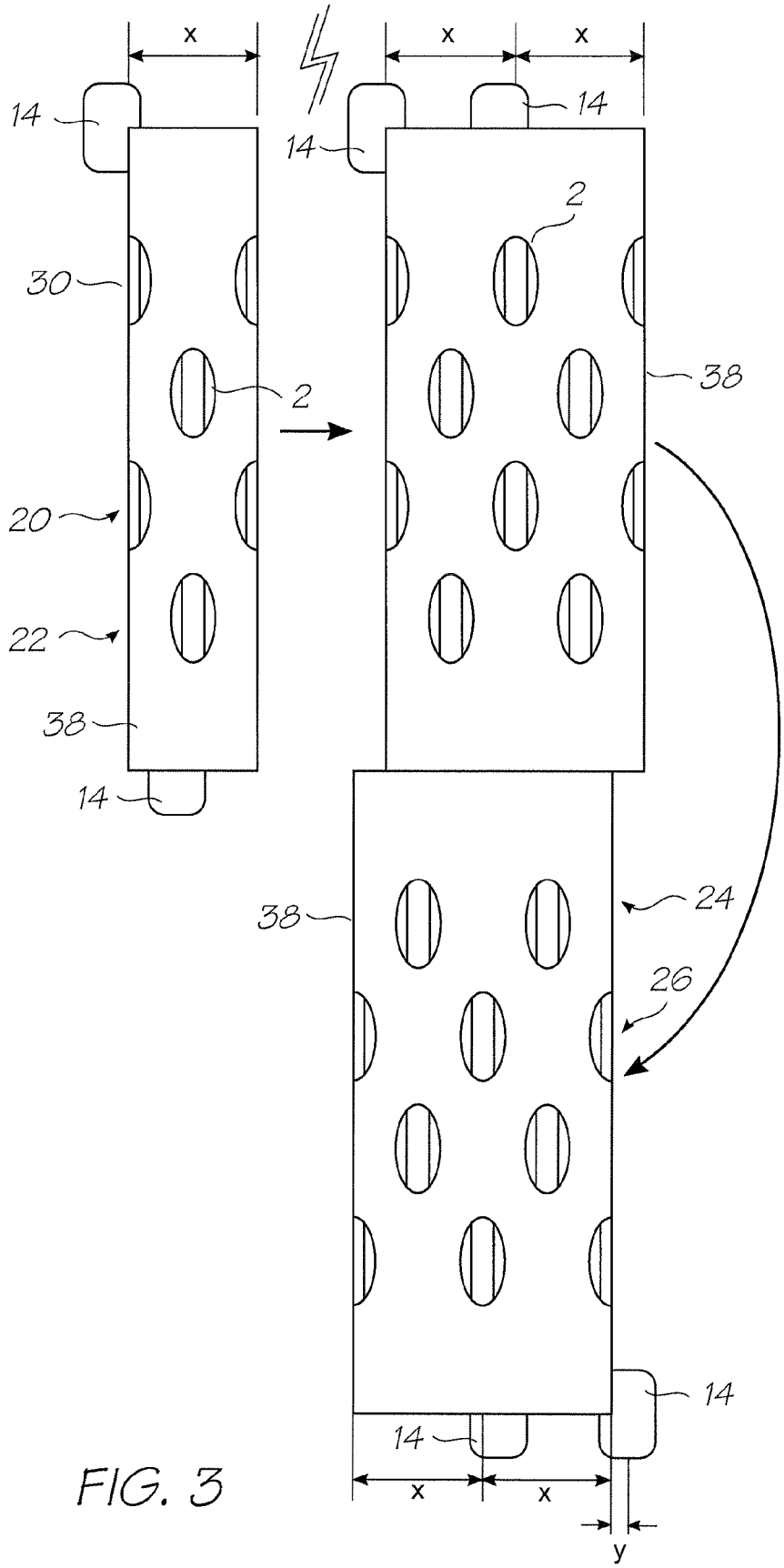
FIG. 3 shows the unit cell replication pattern that makes up the nozzle array.

FIG. 3 shows the unit cell replication pattern that makes up the nozzle array. Each unit cell 38 is translated by its width x across the wafer. The adjacent rows are flipped to a mirror image and translated by half the width: 0.5 x=y. As discussed above, this provides a combined nozzle pitch for the rows of one color channel (20, 22, 24 and 26) of 0.25 x. In the embodiment shown, x=31.75 and x=7.9375. This provides a 3200 dpi resolution without reducing the size of the heaters, chambers or nozzles. Accordingly, when operating at 3200 dpi, the print density is higher than the 1600 dpi printhead of U.S. Ser. No. 11/246,687 filed 11 Oct. 2005, or the printer can operate at 1600 dpi to extend the life of the nozzles with a good print density. This feature of the printhead is discussed further below.

Heater Contact Arrangement

The heater elements 30 and respective contacts 34 and 36 are the same dimensions as the 1600 dpi printhead IC of U.S. Ser. No. 11/246,687 filed 11 Oct. 2005. However, as there is twice the number of contacts, there is twice the number of FET contacts (negative contacts) that punctuate the 'power plane' (the CMOS metal layer carrying the positive voltage). A high density of holes in the power plane creates high resistance through the thin pieces of metal between the holes. This resistance is detrimental to overall printhead efficiency and can reduce the drive pulse to some heaters relative to others.

Figure 4:
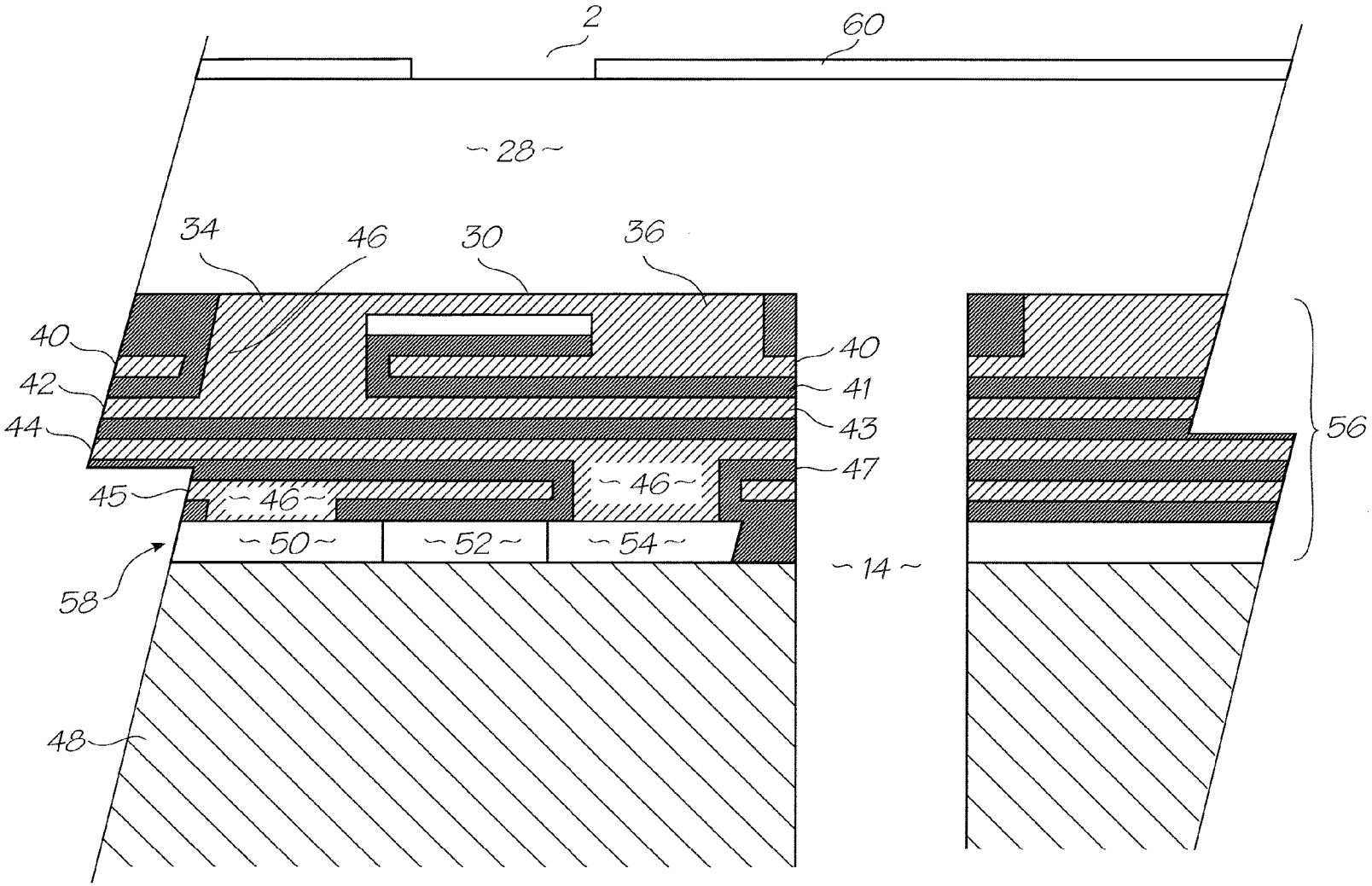
FIG. 4 is a schematic cross section through the CMOS layers and heater element of a nozzle.

FIG. 4 is a schematic section view of the wafer, CMOS drive circuitry 56 and the heater. The drive circuitry 56 for each printhead IC is fabricated on the wafer substrate 48 in the form of several metal layers 40, 42, 44 and 45 separated by dielectric material 41, 43 and 47 through which vias 46 establish the required inter layer connections. The drive circuitry 56 has a drive FET (field effect transistor) 58 for each actuator 30. The source 54 of the FET 58 is connected to a power plane 40 (a metal layer connected to the position voltage of the power supply) and the drain 52 connects to a ground plane 42 (the metal layer at zero voltage or ground). Also connected to the ground plane 42 and the power plane 40 are the electrodes 34 and 36 or each of the actuators 30.

The power plane 40 is typically the uppermost metal layer and the ground plane 42 is the metal layer immediately beneath (separated by a dielectric layer 41). The actuators 30, ink chambers 28 and nozzles 2 are fabricated on top of the power plane metal layer 40. Holes 46 and etched through this layer so that the negative electrode 34 can connect to the ground plane and an ink passage 14 can extend from the rear of the wafer substrate 48 to the ink chambers 28. As the nozzle density increases, so to does the density of these holes, or punctuations through the power plane. With a greater density of punctuations through the power plane, the gaps between the punctuations are reduced. The thin bridge of metal layer though these gaps is a point of relatively high electrical resistance. As the power plane is connected to a supply along one side of the printhead IC, the current to actuators on the non-supply side of the printhead IC may have had to pass through a series of these resistive gaps. The increased parasitic resistance to the non-supply side actuators will affect their drive current and ultimately the drop ejection characteristics from those nozzles.

Figure 5A:
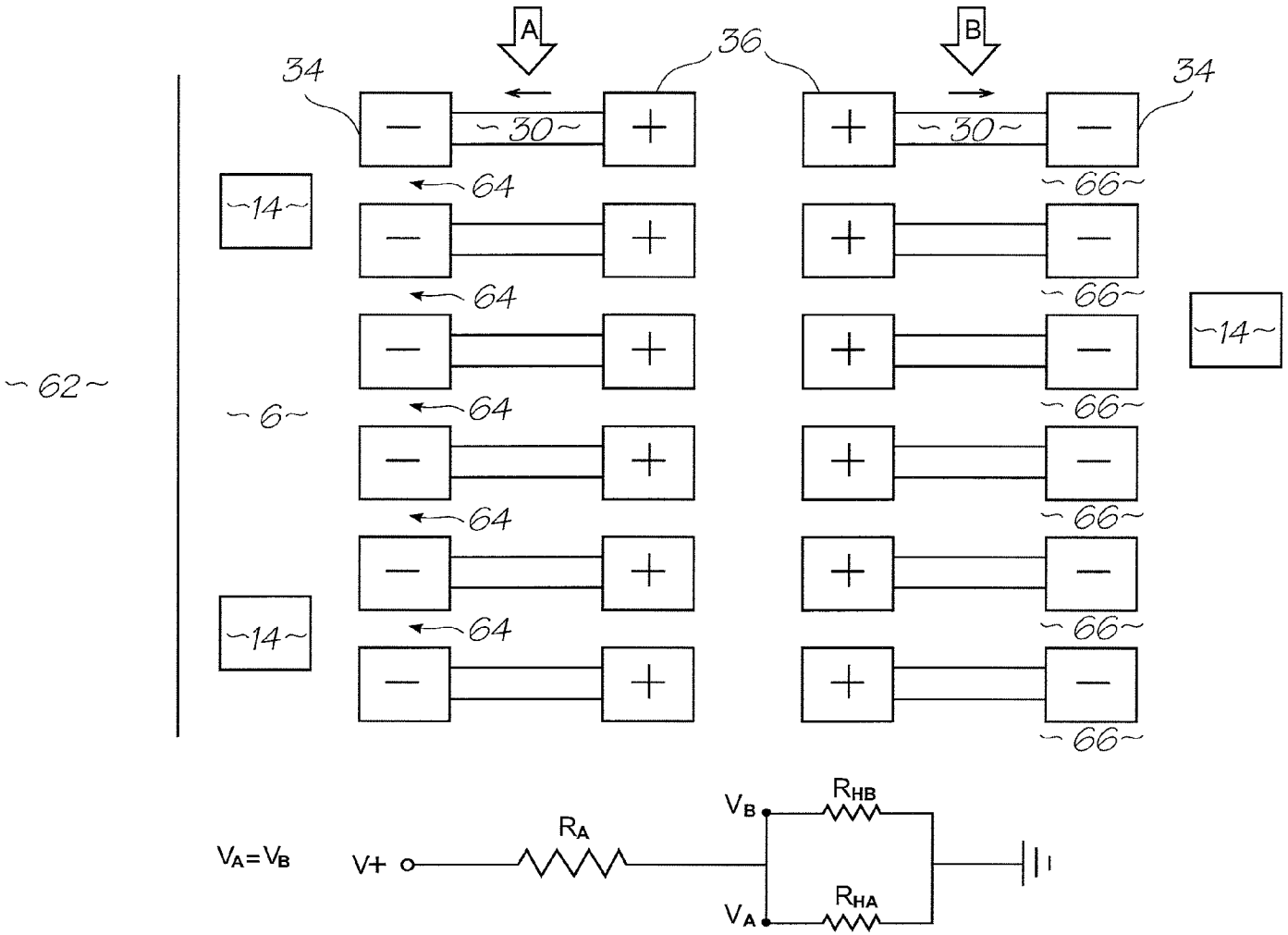
FIG. 5A schematically shows an electrode arrangement with opposing electrode polarities in adjacent actuator rows.

The printhead uses several measures to address this. Firstly, adjacent rows of actuators have opposite current flow directions. That is, the electrode polarity in one rows is switched in the adjacent row. For the purposes of this aspect of the printhead, two rows of nozzles adjacent the supply channel 6 should be considered as a single row as shown in FIG. 5A instead of staggered as shown in the previous figures. The two rows A and B extend longitudinally along the length of the printhead IC. All the negative electrodes 34 are along the outer edges of the two adjacent rows A and B. The power is supplied from one side, say edge 62, and so the current only passes through one line of thin, resistive metal sections 64 before it flows through the heater elements 30 in both rows. Accordingly, the current flow direction in row A is opposite to the current flow direction in row B.

The corresponding circuit diagram illustrates the benefit of this configuration. The power supply V+ drops because of the resistance $R_A$ of the thin sections between the negative electrodes 34 of row A. However, the positive electrodes 36 for all the heaters 30 are at the same voltage relative to ground ($V_A$=$V_B$). The voltage drop across all heaters 30 (resistances $R_{HA}$ and $R_{HB}$ respectively) in both rows A and B is uniform. The resistance $R_B$ from the thin bridges 66 between the negative electrodes 34 of row B is eliminated from the circuit for rows A and B.

Figure 5B:
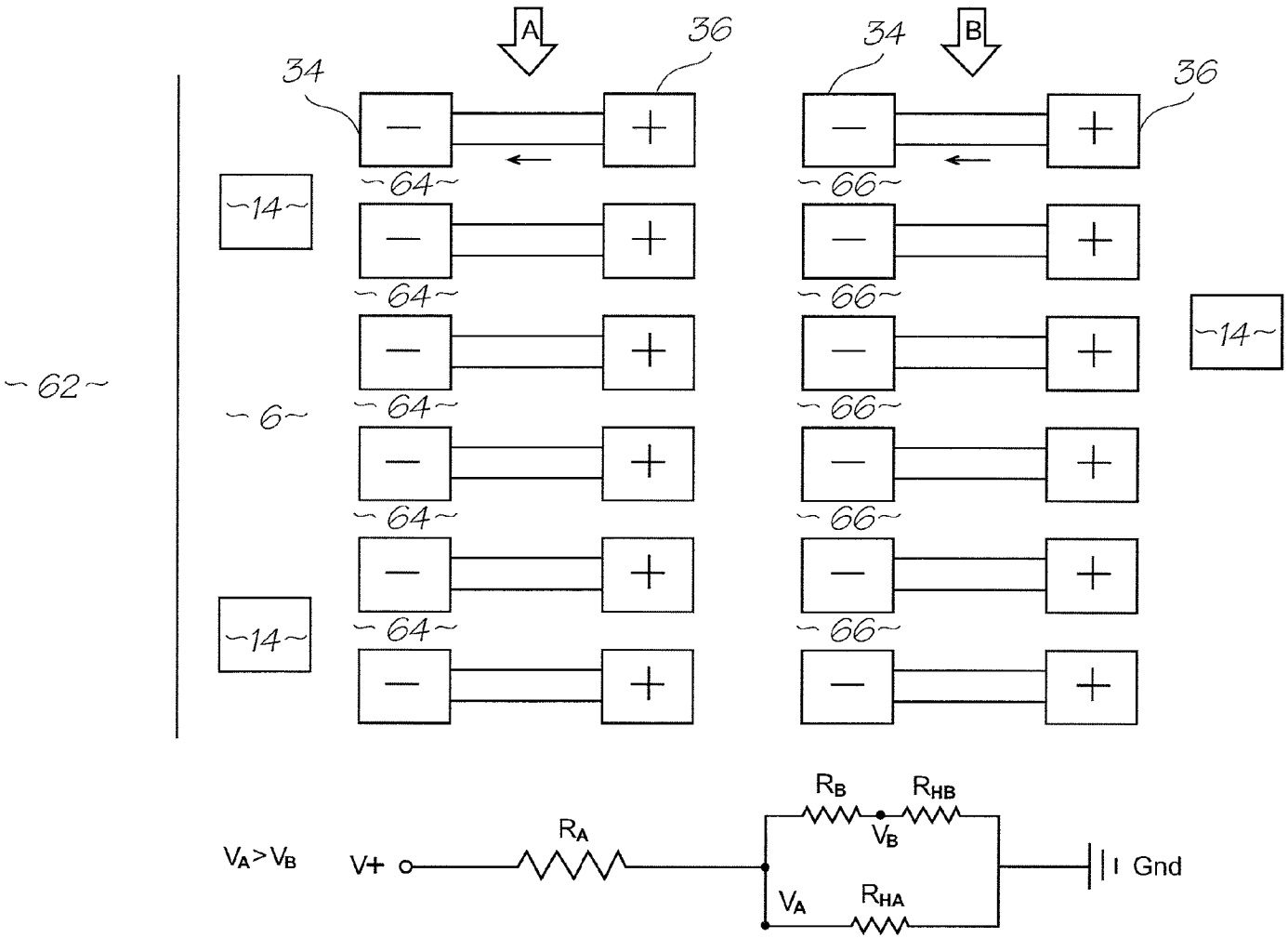
FIG. 5B schematically shows an electrode arrangement with typical electrode polarities in adjacent actuator rows.

FIG. 5B shows the situation if the polarities of the electrodes in adjacent rows are not opposing. In this case, the line of resistive sections 66 in row B are in the circuit. The supply voltage V+ drops through the resistance $R_A$ to $V_A$—the voltage of the positive electrodes 36 of row A. From there the voltage drops to ground through the resistance $R_{HA}$ of the row A heaters 30. However, the voltage $V_B$ at the row B positive electrodes 36 drop from $V_A$ though $R_B$ from the thin section 66 between the row B negative electrodes. Hence the voltage drop though the row B heaters 30 is less than that of row A. This in turn changes the drive pulse and therefore the drop ejection characteristics.

Figure 6:
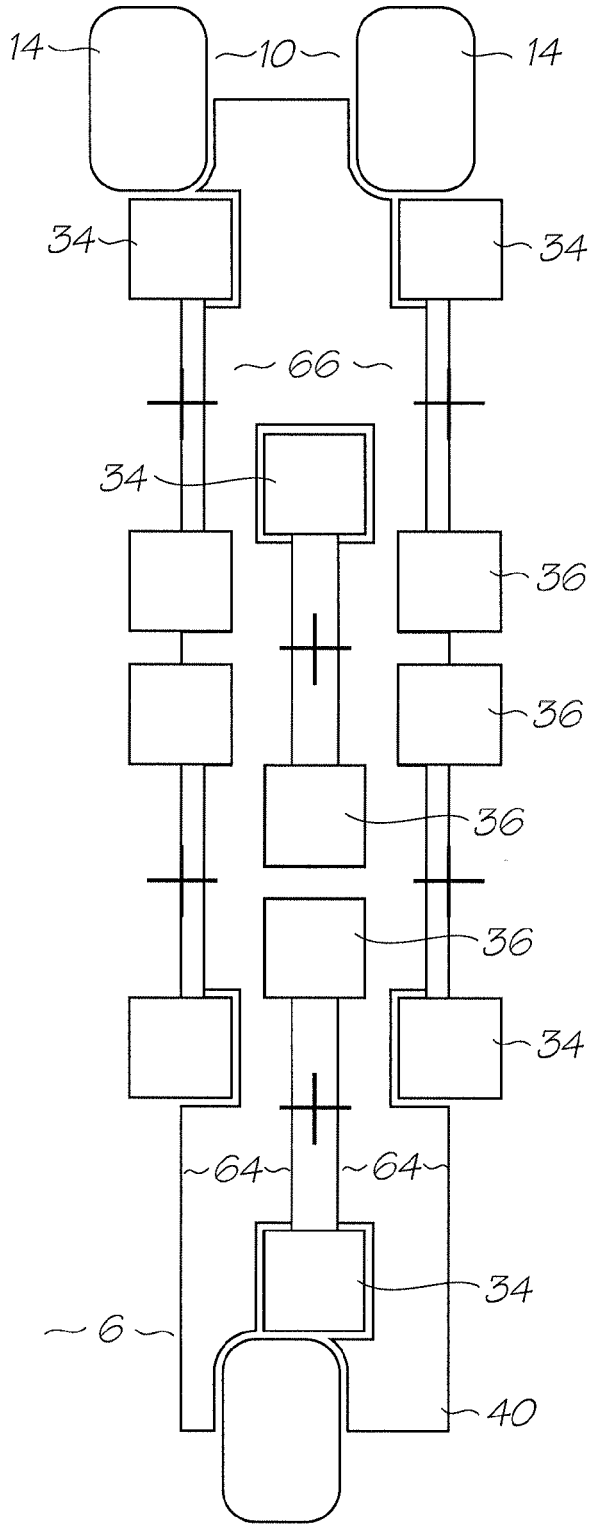
FIG. 6 shows the electrode configuration of the printhead IC of FIG. 1.
Figure 7:
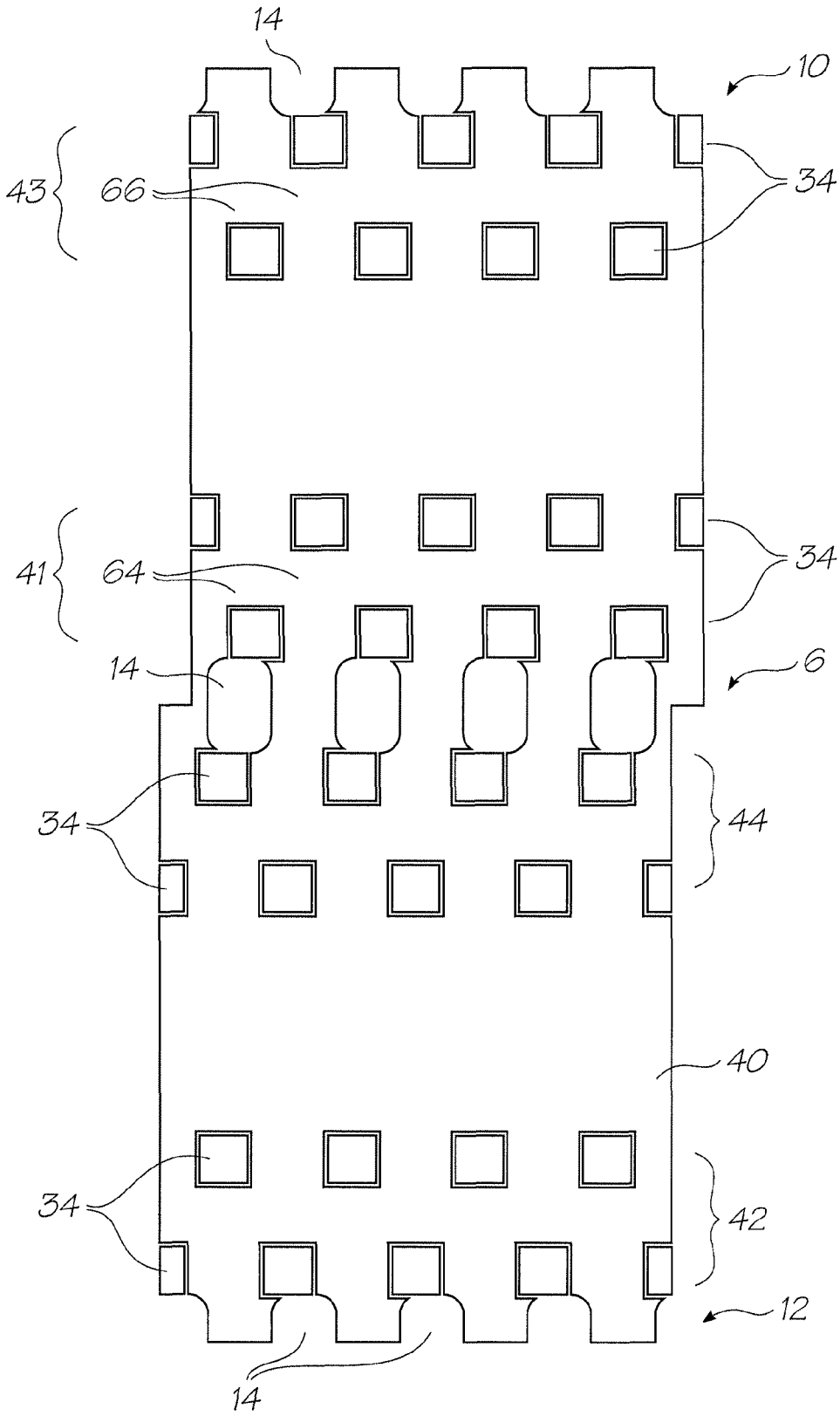
FIG. 7 shows a section of the power plane of the CMOS layers.

The second measure used to maintain the integrity of the power plane is staggering adjacent electrodes pairs in each row. Referring to FIG. 6, the negative electrodes 34 are now staggered such that every second electrode is displaced transversely to the row. The adjacent row of heater contacts 34 and 36 are likewise staggered. This serves to further widen the gaps 64 and 66 between the holes through the power plane 40. The wider gaps have less electrical resistance and the voltage drop to the heaters remote from the power supply side of the printhead IC is reduced. FIG. 7 shows a larger section of the power plane 40. The electrodes 34 in staggered rows 41 and 44 correspond to the color channel feed by supply channel 6. The staggered rows 42 and 43 relate to one half the nozzles for the color channels on either side—the color fed by supply channel 10 and the color channel fed by supply channel 12. It will be appreciated that a five color channel printhead IC has nine rows of negative electrodes that can induce resistance for the heaters in the nozzles furthest from the power supply side. Widening the gaps between the negative electrodes greatly reduces the resistance they generate. This promotes more uniform drop ejection characteristics from the entire nozzle array.

The features described above increase the density of nozzles on the wafer. Each individual integrated circuit is about 22 mm long, less than 3 mm wide and can support more than 10000 nozzles. This represents a significant increase on the nozzle numbers (70,400 nozzles per IC) in the Applicants 1600 dpi printhead ICs (see for examples U.S. Ser. No. 11/246,687 filed 11 Oct. 2005). In fact, a true 3200 dpi printhead nozzle array fabricated to the dimensions shown in FIG. 12, has 12,800 nozzles.

Figure 14:
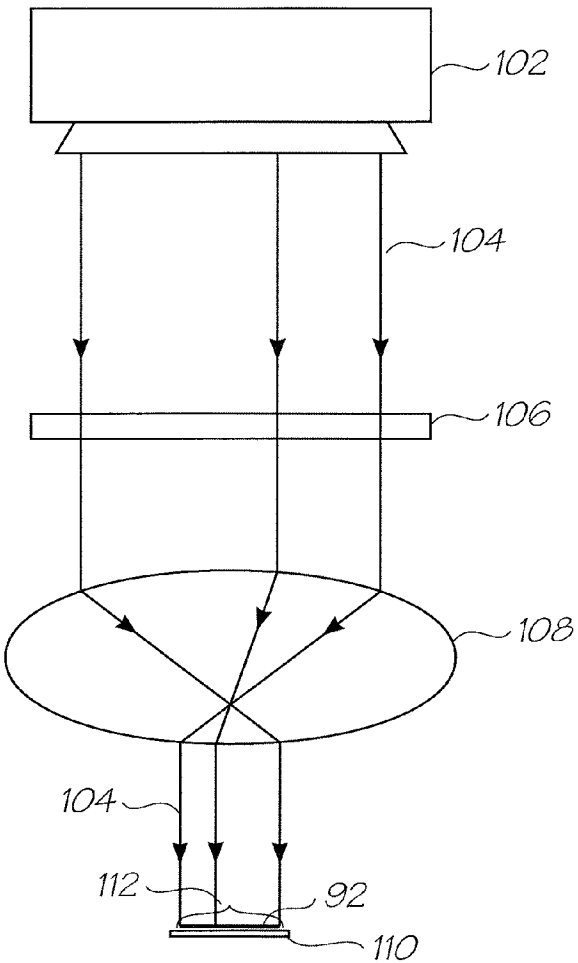
FIG. 14 is a sketch of a photolithographic stepper.

The lithographic fabrication of this many nozzles (more than 10,000) is efficient because the entire nozzle array fits within the exposure area of the lithographic stepper or scanner used to expose the reticles (photomasks). A photolithographic stepper is sketched in FIG. 14. A light source 102 emits parallel rays of a particular wavelength 104 through the reticle 106 that carries the pattern to be transferred to the integrated circuit 92. The pattern is focused through a lens 108 to reduce the size of the features and projected onto a wafer stage 110 the carries the integrated circuits 92 (or 'dies' as they are also known). The area of the wafer stage 110 illuminated by the light 104 is called the exposure area 112. Unfortunately, the exposure area 112 is limited in size to maintain the accuracy of the projected pattern—whole wafer discs can not be exposed simultaneously. The vast majority of photolithographic steppers have an exposure area 112 less than 30 mm by 30 mm. One major manufacturer, ASML of the Netherlands, makes steppers with an exposure area of 22 mm by 22 mm which is typical of the industry.

The stepper exposes one die, or a part of a die, and then steps to another, or another part of the same die. Having as many nozzles as possible on a single monolithic substrate is advantageous for compact printhead design and minimizing the assembly of the ICs on a support in precise relation to one another. The invention configures the nozzle array so that more than 10,000 nozzles fit into the exposure area. In fact the entire integrated circuit can fit into the exposure area so that more than 14,000 nozzles are fabricated on a single monolithic substrate without having to step and realign for each pattern.

Figure 15A:
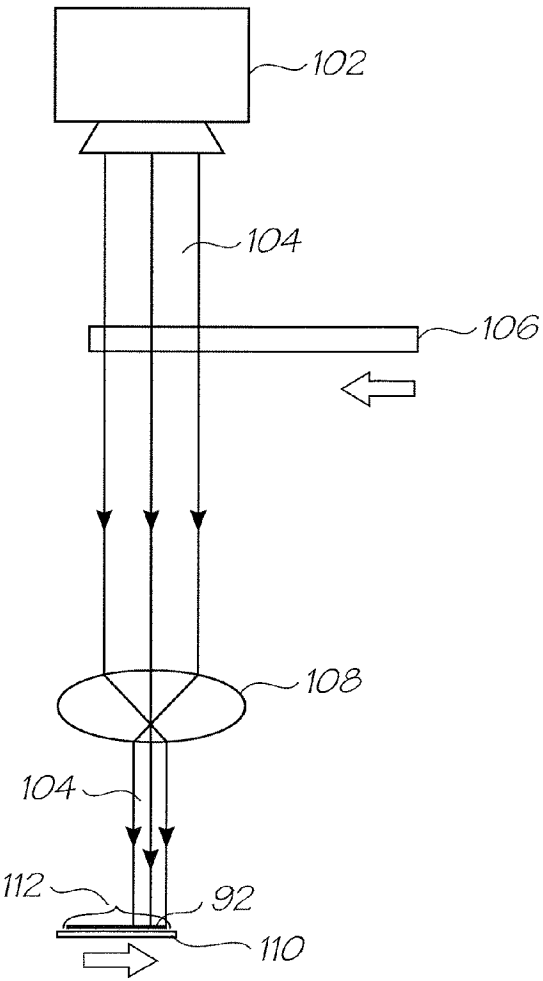
FIGS. 15A to 15C schematically illustrate the operation of a photolithographic stepper.
Figure 15C:
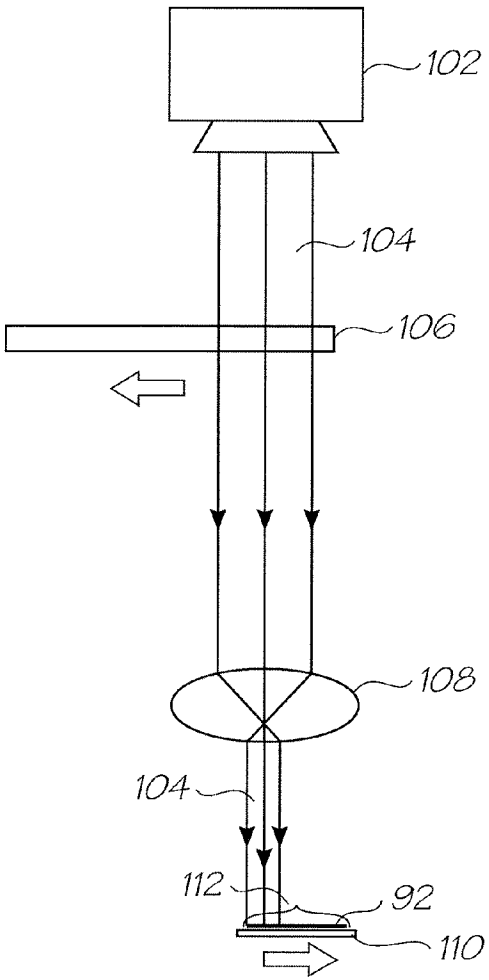
Figure 15B:
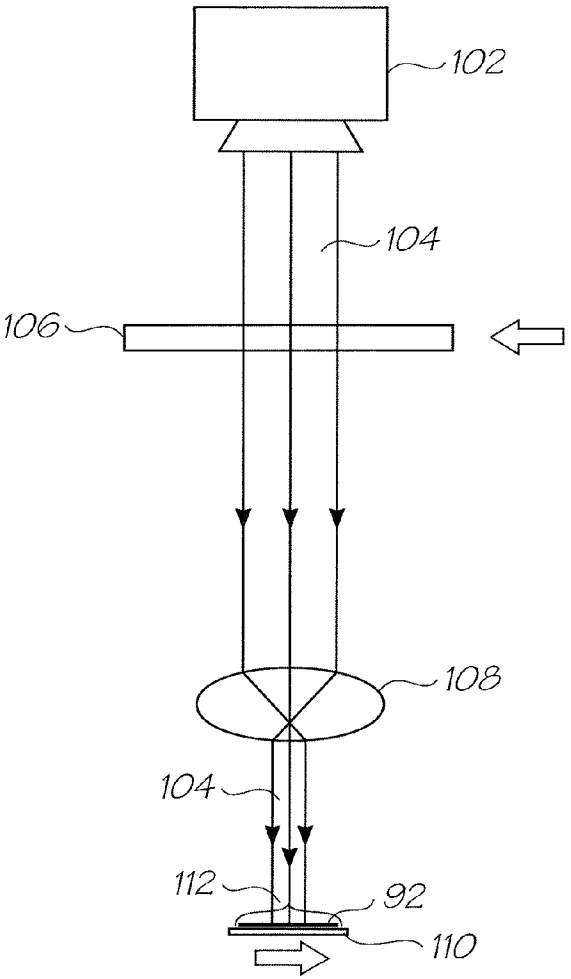

The ordinary worker will appreciate that the same applies to fabrication of the nozzle array using a photolithographic scanner. The operation of a scanner is sketched in FIG. 15A to 15. In a scanner, the light source 102 emits a narrower beam of light 104 that is still wide enough to illuminate the entire width of the reticle 106. The narrow beam 104 is focused through a smaller lens 108 and projected onto part of the integrated circuit 92 mounted in the exposure area 112. The reticle 106 and the wafer stage 110 are moved in opposing directions relative to each other so that the reticle's pattern is scanned across the entire exposure area 112.

Clearly, this type of photo-imaging device is also suited to efficient fabrication of printhead ICs with large numbers of nozzles.

Flat Exterior Nozzle Surface

As discussed above, the printhead IC is fabricated in accordance with the steps listed in cross referenced U.S. Ser. No. 11/246,687 filed 11 Oct. 2005. Only the exposure mask patterns have been changed to provide the different chamber and heater configurations. As described in MNN001US, the roof layer and the chamber walls are an integral structure—a single Plasma Enhanced Chemical Vapor Deposition (PECVD) of suitable roof and wall material. Suitable roof materials may be silicon nitride, silicon oxide, silicon oxynitride, aluminium nitride etc. The roof and walls are deposited over a scaffold layer of sacrifical photoresist to form an integral structure on the passivation layer of the CMOS.

Figure 8:
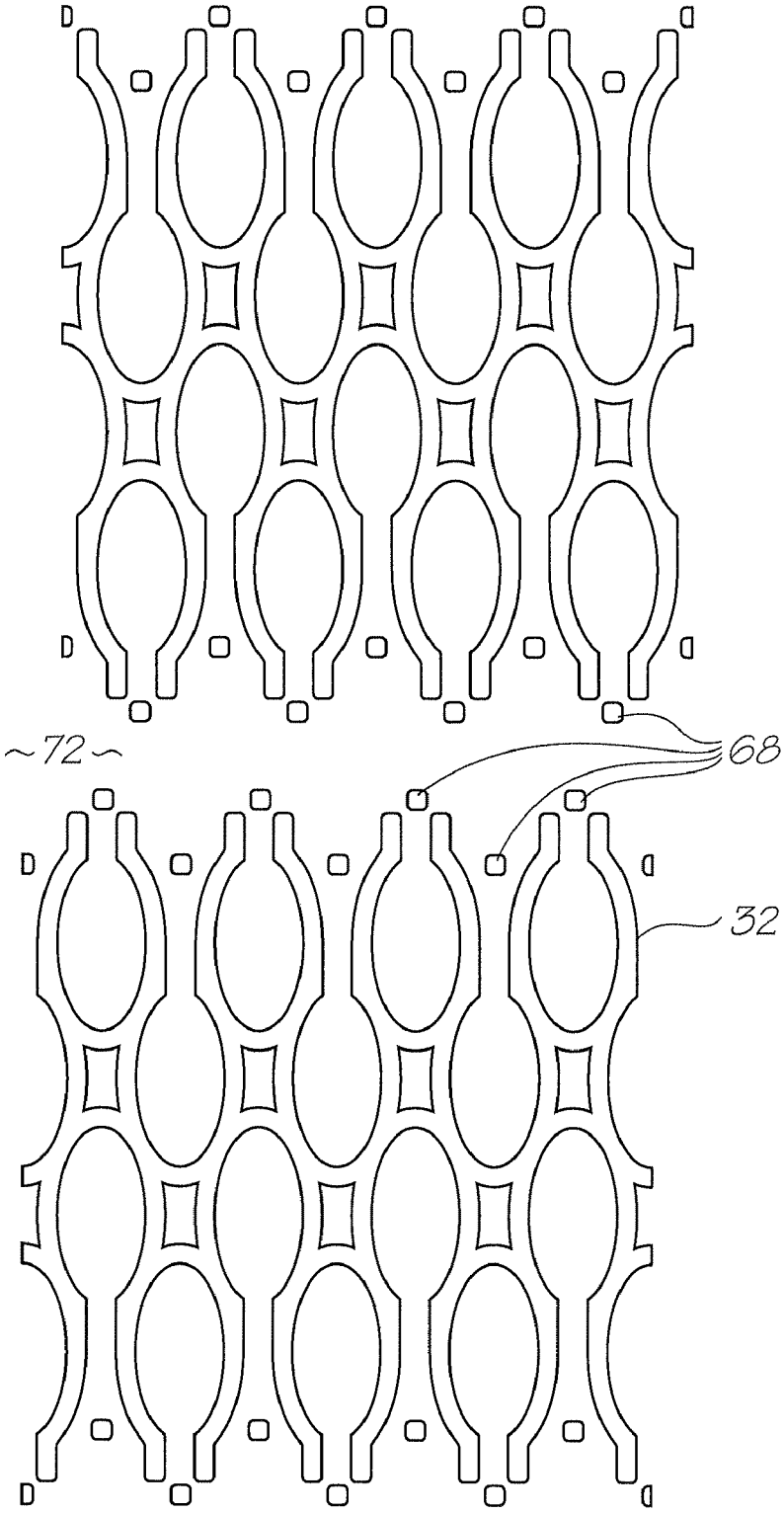
FIG. 8 shows the pattern etched into the sacrificial scaffold layer for the roof/side wall layer.

FIG. 8 shows the pattern etched into the sacrifical layer 72. The pattern consists of the chamber walls 32 and columnar features 68 (discussed below) which are all of uniform thickness. In the embodiment shown, the thickness of the walls and columns is 4 microns. These structures are relatively thin so when the deposited roof and wall material cools there is little if any depression in the exterior surface of the roof layer 70 (see FIG. 9). Thick features in the etch pattern will hold a relatively large volume of the roof/wall material. When the material cools and contracts, the exterior surface draws inwards to create a depression.

Figure 9:
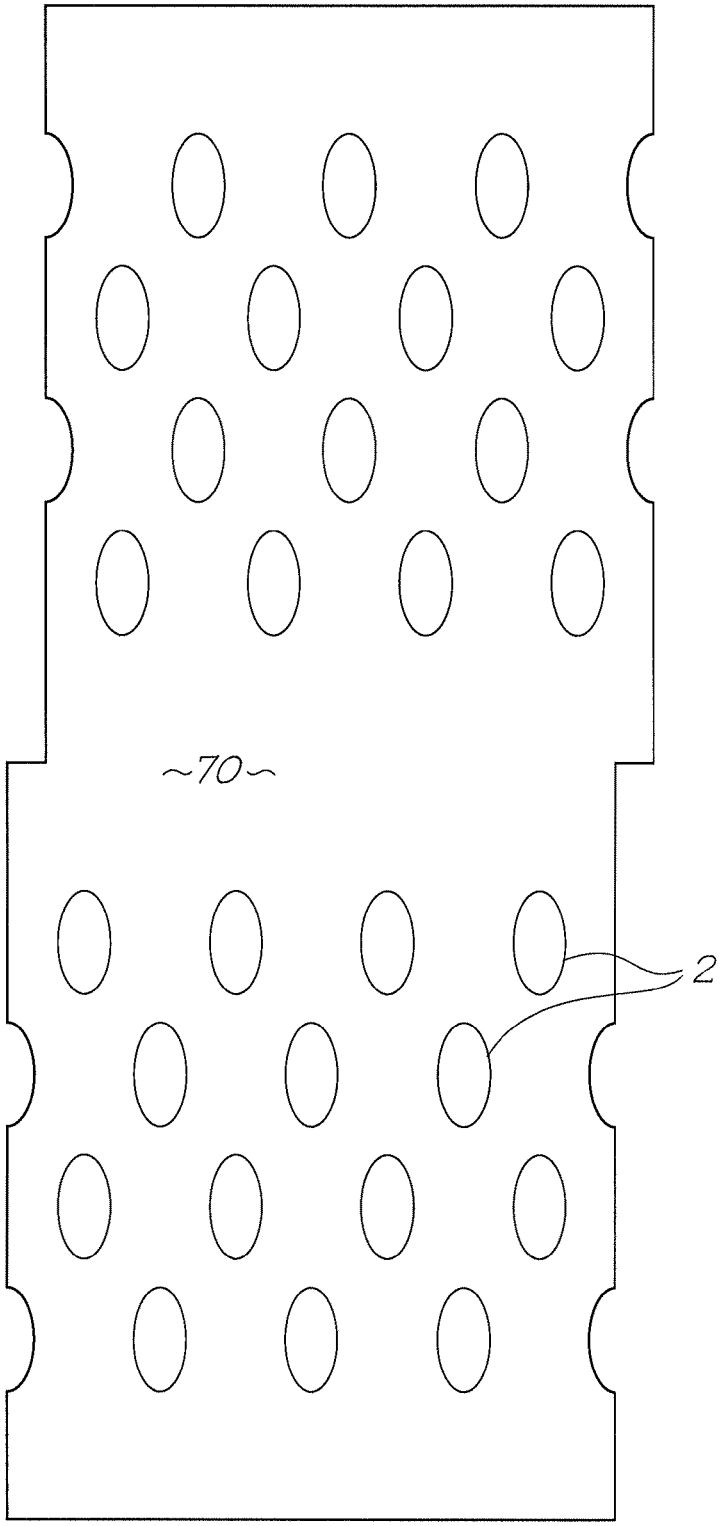
FIG. 9 shows the exterior surface of the roof layer after the nozzle apertures have been etched.

These depressions leave the exterior surface uneven which can be detrimental to the printhead maintenance. If the printhead is wiped or blotted, paper dust and other contaminants can lodge in the depressions. As shown in FIG. 9, the exterior surface of the roof layer 72 is flat and featureless except for the nozzles 2. Dust and dried ink is more easily removed by wiping or blotting.

Refill Ink Flow

Figure 10:
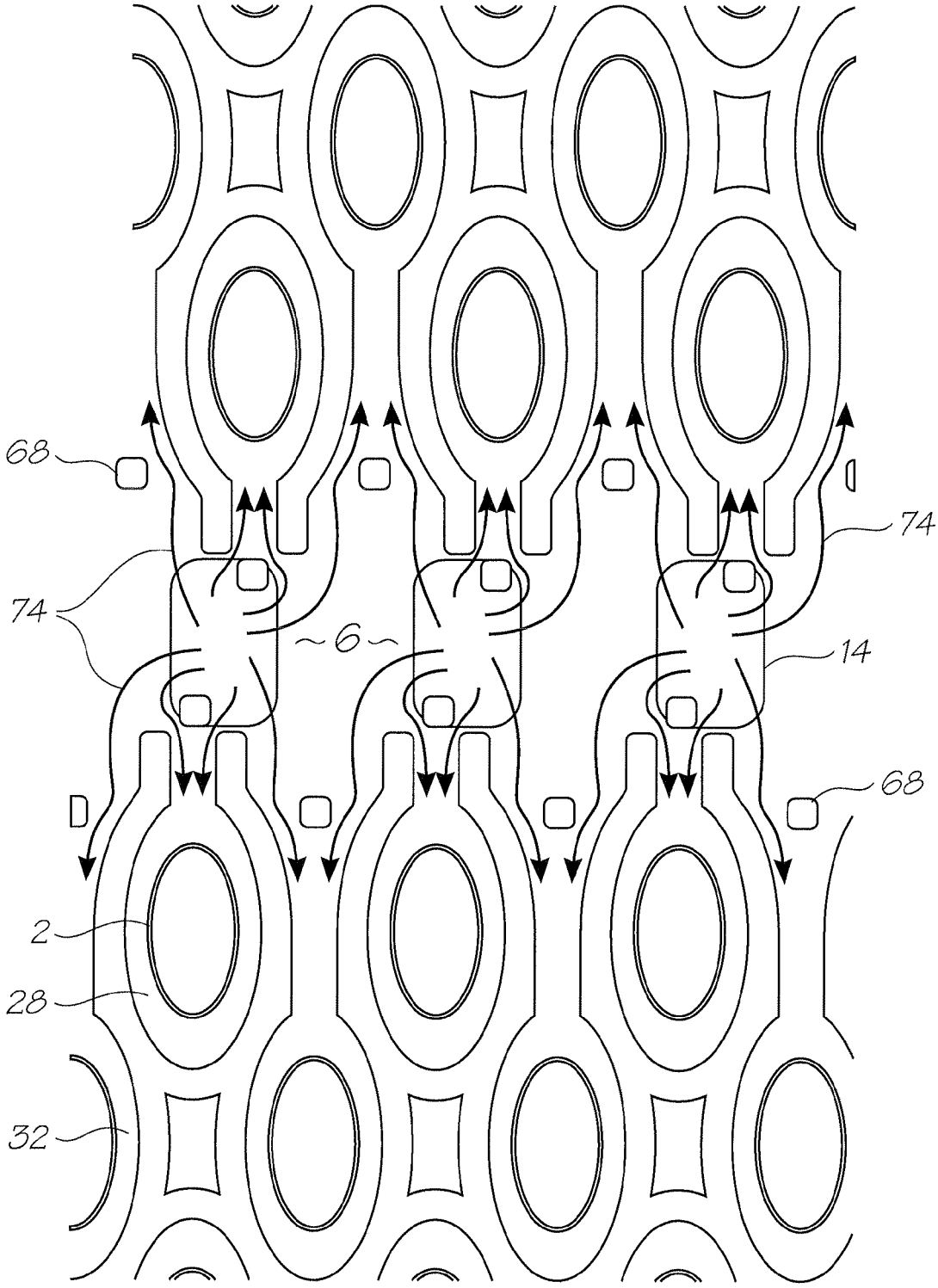
FIG. 10 shows the ink supply flow to the nozzles.

Referring to FIG. 10, each ink supplies four nozzles except at the longitudinal ends of the array where the inlets supply fewer nozzles. Redundant nozzle inlets 14 are an advantage during initial priming and in the event of air bubble obstruction.

As shown by the flow lines 74, the refill flow to the chambers 28 remote from the inlets 14 is longer than the refill flow to the chambers 28 immediately proximate the supply channel 6. For uniform drop ejection characteristics, it is desirable to have the same ink refill time for each nozzle in the array.

Figure 11:
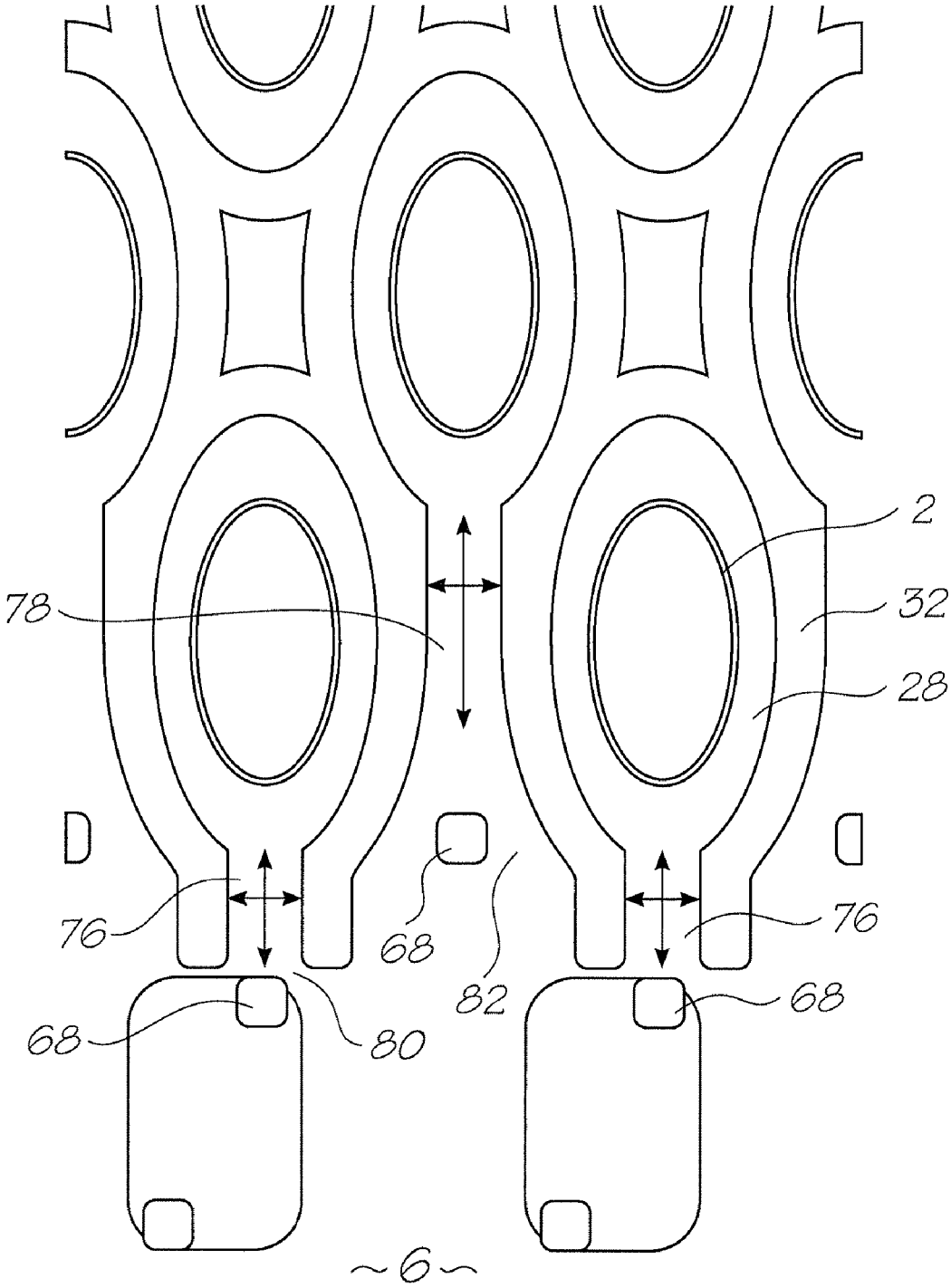
FIG. 11 shows the different inlets to the chambers in different rows.

As shown in FIG. 11, the inlets 76 to the proximate chambers are dimensioned differently to the inlets 78 to the remote chambers. Likewise the column features 68 are positioned to provide different levels of flow constriction for the proximate nozzle inlets 76 and the remote nozzle inlets 78. The dimensions of the inlets and the position of the column can tune the fluidic drag such that the refill times of all the nozzles in the array are uniform. The columns can also be positioned to damp the pressure pulses generated by the vapor bubble in the chamber 28. Damping pulses moving though the inlet prevents fluidic cross talk between nozzles. Furthermore, the gaps 80 and 82 between the columns 68 and the sides of the inlets 76 and 78 can be effective bubble traps for larger outgassing bubbles entrained in the ink refill flow.

Extended Nozzle Life

Figure 12:
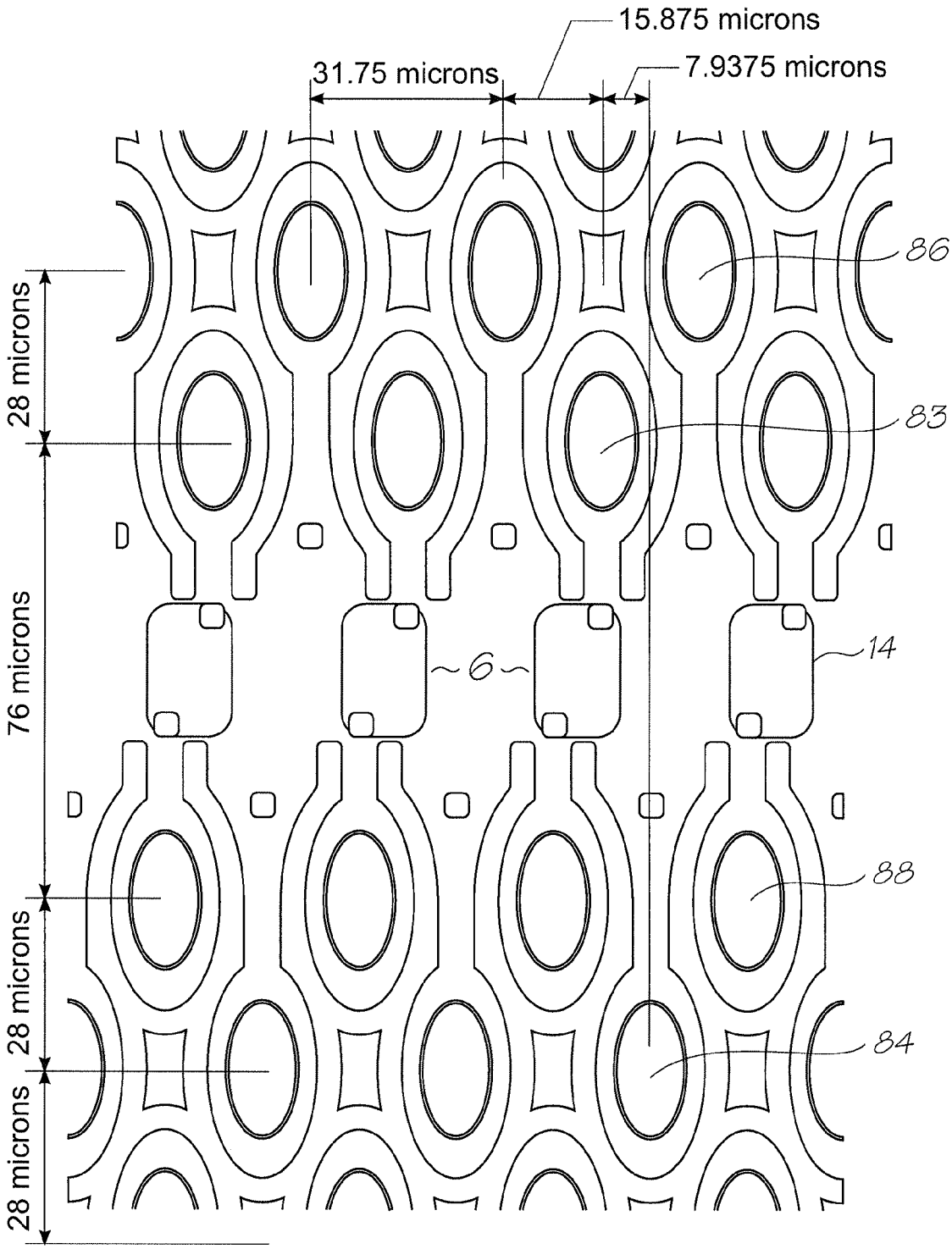
FIG. 12 shows the nozzle spacing for one color channel.

FIG. 12 shows a section of one color channel in the nozzle array with the dimensions necessary for 3200 dpi resolution. It will be appreciated that 'true' 3200 dpi is very high resolution—greater than photographic quality. This resolution is excessive for many print jobs. A resolution of 1600 dpi is usually more than adequate. In view of this, the printhead IC sacrifice resolution by sharing the print data between two adjacent nozzles. In this way the print data that would normally be sent to one nozzle in a 1600 dpi printhead is sent alternately to adjacent nozzles in a 3200 dpi printhead. This mode of operation more than doubles the life of the nozzles and its allows the printer to operate at much higher print speeds. In 3200 dpi mode, the printer prints at 60 ppm (full color A4) and in 1600 dpi mode, the speed approaches 120 ppm.

An additional benefit of the 1600 dpi mode is the ability to use this printhead IC with print engine controllers (PEC) and flexible printed circuit boards (flex PCBs) that are configured for 1600 dpi resolution only. This makes the printhead IC retro-compatible with the Applicant's earlier PECs and PCBs.

As shown in FIG. 12, the nozzle 83 is transversely offset from the nozzle 84 by only 7.9375 microns. They are spaced further apart in absolute terms but displacement in the paper feed direction can be accounted for with the timing of nozzle firing sequence. As the 8 microns transverse shift between adjacent nozzles is small, it can be ignored for rendering purposes. However, the shift can be addressed by optimizing the dither matrix if desired.

Bubble, Chamber and Nozzle Matching

Figure 13:
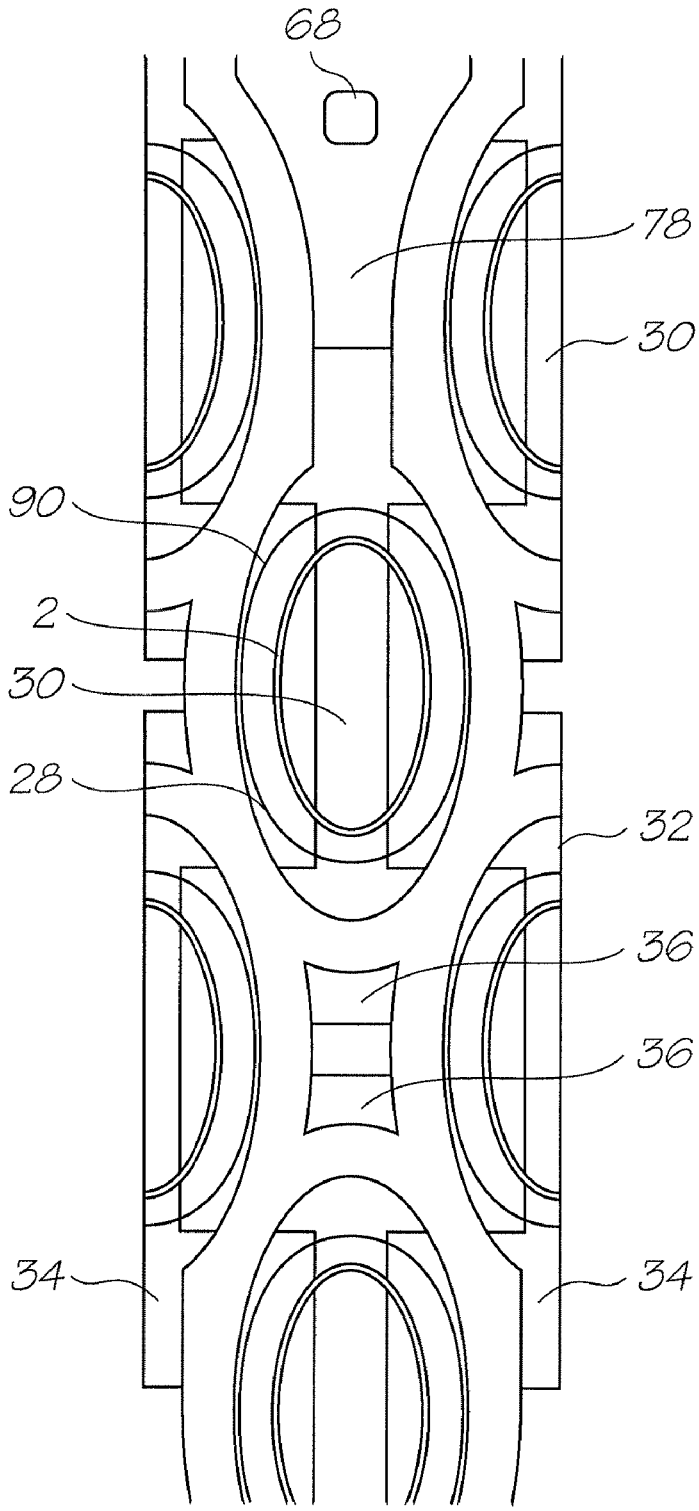
FIG. 13 shows an enlarged view of the nozzle array with matching elliptical chamber and ejection aperture.

FIG. 13 is an enlarged view of the nozzle array. The ejection aperture 2 and the chamber walls 32 are both elliptical. Arranging the major axes parallel to the media feed direction allows the high nozzle pitch in the direction transverse to the feed direction while maintaining the necessary chamber volume. Furthermore, arranging the minor axes of the chamber so that they overlap in the transverse direction also improves the nozzle packing density.

The heaters 30 are a suspended beam extending between their respective electrodes 34 and 36. The elongate beam heater elements generate a bubble that is substantially elliptical (in a section parallel to the plane of the wafer). Matching the bubble 90, chamber 28 and the ejection aperture 2 promotes energy efficient drop ejection. Low energy drop ejection is crucial for a 'self cooling' printhead.

CONCLUSION

The printhead IC shown in the drawings provides 'true' 3200 dpi resolution and the option of significantly higher print speeds at 1600 dpi. The print data sharing at lower resolutions prolongs nozzle life and offers compatibility with existing 1600 dpi print engine controllers and flex PCBs. The uniform thickness chamber wall pattern gives a flat exterior nozzle surface that is less prone to clogging. Also the actuator contact configuration and alongate nozzle structures provide a high nozzle pitch transverse to the media feed direction while keeping the nozzle array thin parallel to the media feed direction.

The specific embodiments described are in all respects merely illustrative and in no way restrictive on the spirit and scope of the broad inventive concept.

The invention claimed is:

1. A printhead integrated circuit for an inkjet printhead, the printhead integrated circuit comprising:

a monolithic wafer substrate supporting an array of droplet ejectors for ejecting drops of printing fluid onto print media, each drop ejector having a nozzle and an actuator for ejecting a drop of printing fluid through the nozzle and the array having more than 10000 of the droplet ejectors; wherein, the actuators are arranged in adjacent rows, each having electrodes spaced from each other in a direction transverse to the rows for connection to respective drive transistors and a power supply, the electrodes of the actuators in adjacent rows having opposing polarities such that the actuators in adjacent rows have opposing current flow directions.

2. A printhead integrated circuit according to claim 1 wherein the array has more than 12000 of the droplet ejectors.

3. A printhead integrated circuit according to claim 1 wherein during use, the print media moves in a print direction relative to the printhead; and, the nozzles in the array are spaced apart from each other by less than 10 microns in the direction perpendicular to the print direction.

4. A printhead integrated circuit according to claim 3 wherein the nozzles in the array that are spaced apart from each other by less than 10 microns in the direction perpendicular to the print direction, are also spaced apart from each other in the print direction by less than 150 microns.

5. A printhead integrated circuit according to claim 1 wherein the array has more than 700 of the droplet ejectors per square millimeter.

6. A printhead integrated circuit according to claim 1 wherein the electrodes in each row are offset from its adjacent actuators in a direction transverse to the row such that the electrodes of every second actuator are collinear.

7. A printhead integrated circuit according to claim 6 wherein the monolithic wafer substrate is elongate and extends parallel to the rows of the actuators, such that in use power and data is supplied along a long edge of the wafer substrate.

8. An inkjet printhead comprising a plurality of printhead integrated circuits according to claim 1 and further comprising:

a print engine controller (PEC) for sending print data to the array of droplet ejectors; wherein, during use the print engine controller can selectively reduce the print resolution by apportioning print data for a single droplet ejector between at least two droplet ejectors of the array.

9. An inkjet printhead according to claim 8 wherein the two nozzles are positioned in the array such that they are nearest neighbours in a direction transverse to the movement of the printhead relative to a print media substrate.

10. An inkjet printhead according to claim 9 wherein the PEC shares the print data equally between the two nozzles in the array.

11. An inkjet printhead according to claim 10 wherein the two nozzles are spaced at less than 40 micron centers.

12. An inkjet printhead according to claim 10 wherein the printhead is a pagewidth printhead and the two nozzles are spaced in a direction transverse to the media feed direction at less than 16 micron centers.

13. An inkjet printhead according to claim 10 wherein the adjacent nozzles are spaced in a direction transverse to the media feed direction at less than 8 micron centers.

14. An inkjet printhead comprising a plurality of printhead integrated circuits according to claim 1 mounted end to end to form a pagewidth printhead for a printer configured to feed media past the printhead is a media feed direction, the printhead having more than 100000 of the nozzles and extends in a direction transverse to the media feed direction between 200 mm and 330 mm.

15. An inkjet printhead according to claim 14 wherein the array has more than 140000 of the nozzles.

16. A printhead integrated circuit according to claim 1 wherein the array of droplet ejectors has a nozzle pitch greater than 1600 nozzle per inch (npi) in a direction transverse to a media feed direction.

17. An inkjet printhead according to claim 16 wherein the nozzle pitch is greater than 3000 npi.

* * * * *